US005521140A

United States Patent [19]

Matsuda et al.

[11] Patent Number: 5,521,140

[45] Date of Patent: May 28, 1996

[54] RECORDING UNIT STRUCTURE AND RECORDING DEVICE

[75] Inventors: Osamu Matsuda; Toshimasa Kobayashi; Shuji Sato; Hideki Hirano; Kenji Shinozaki; Takayuki Fujioka, all of Kanagawa, Japan

[73] Assignee: Sony Corporation, Tokyo, Japan

[21] Appl. No.: 326,377

[22] Filed: Oct. 20, 1994

[30] Foreign Application Priority Data

Oct. 22, 1993 [JP] Japan ..... 5-287801
Apr. 28, 1994 [JP] Japan ..... 6-114643

[51] Int. Cl.[6] ..... B41M 5/035; B41M 5/38

[52] U.S. Cl. ..... 503/227; 347/171; 428/195; 428/318.4; 428/323; 428/913; 428/914; 430/200; 430/945

[58] Field of Search ..... 8/471; 428/195, 428/206, 318.4, 913, 914, 323; 503/227; 347/171; 430/200, 945

[56] References Cited

U.S. PATENT DOCUMENTS 4,772,582 9/1988 De Boer ..... 503/227
5,352,651 10/1994 Debe et al. ..... 503/227

FOREIGN PATENT DOCUMENTS 2-215592 8/1990 Japan ..... 503/227
3-211088 9/1991 Japan ..... 503/227

*Primary Examiner*—B. Hamilton Hess
*Attorney, Agent, or Firm*—Hill, Steadman & Simpson

[57] ABSTRACT

A recording unit structure comprising a recording material layer faced to a recording body with a space incorporated therebetween, so that said recording material is vaporized and transferred to said recording body through said space, provided that pores are provided to a vaporizing portion of the recording material in such a manner that the pores be present within the layer of the recording material. The recording unit structure of the present invention assures a recording of excellent quality, is made compact and light weight, yields a high thermal efficiency, and produces no used ink sheets and other wastes. The present invention also relates to a recording device comprising the same.

16 Claims, 24 Drawing Sheets

Related Art

RECORDING UNIT STRUCTURE AND RECORDING DEVICE

BACKGROUND OF THE INVENTION

The present invention relates to a recording unit structure and a recording device. In further detail, the present invention relates to a thermal recording unit structure and a thermal recording device comprising the unit structure.

With the move of society into the information age furnished with more colorful recorded images supported by a variety of information media such as video cameras, television sets, and computer graphics, demand is rapidly growing for colored hard copies. To meet for the demand, color printers based on various types of recording methods are developed and provided to a variety of fields.

Among the various types of recording methods is included a technique comprising transferring a transfer dye from an ink sheet to an image receiving layer corresponding to the heat applied to the sheet. This method comprises bringing an ink sheet into contact with an image transfer body while applying a predetermined pressure thereto. More specifically, an ink sheet having thereon an ink layer coating containing a certain type of binder resin having dispersed therein a transfer dye at a high concentration is brought into contact with an image transfer body such as a photographic paper having thereon a dye receiving resin which receives the transferred dye while applying pressure thereto, and heat is applied in correspondence to the image information by means of a thermosensitive recording head placed on the ink sheet.

The operation above is then repeated for each of the image signals obtained by separating the initial image signal into the three subtractive primaries, i.e., yellow, magenta, and cyan. In this manner, a full-color image having a continuous gradation can be obtained by a so-called thermal transfer recording method. The thermal transfer color process is now attracting much attention as a promising technique concerning its capability of making the recording system compact, ease in maintenance, and instantaneous recordability, and yet, it is believed capable of producing high quality images well comparable to those of the conventional silver halide photographs.

Referring to the schematic front view shown in FIG. 33, the essential portion of a printer of a thermal transfer type is described below.

A thermal recording head (hereinafter referred to simply as "a thermal head") 61 is faced to a platen roller 63, and an ink sheet 62 comprising a base film **62*b* having thereon an ink layer 62*a* is interposed between the thermal head 61 and the platen roller 63 together with a recording paper (transfer body) 70 provided thereon a dye receiving resin layer 70*a*. The ink sheet 62 and the transfer body 70 are run together while they are pressed against the thermal head 61 by the rotating platen roller 63**.

Upon heating the ink (transfer dye) in the ink layer **62*a* selectively by the thermal head 61, the ink is transferred to the dye receiving resin (receptor) layer 70*a* of the transfer body 70** to form dotted images thereon. Thermal transfer recording proceeds in this manner. In general, thermal transfer recording is effected in a line process in which a long thermal head is fixed perpendicular to the direction of running the recording paper.

However, a recording method of the type described above suffers the following disadvantages.

(1) The ink sheet which supplies the ink is disposed after using it only once. The used ink sheets hence heap as wastes and cast serious problems concerning energy conservation and environmental protection.

(2) There is also proposed a means of producing full-color images using the ink sheet for a plurality of times with an aim to reduce the wastes. However, concerning that the transfer dye layer and the transfer body are brought into contact with each other, if a transfer dye A is transferred to a transfer body and if another transfer dye B were to be transferred superposed on the previously transferred dye A, the transfer dye A on the transfer body would be transferred back to the layer of the transfer dye B on the ink sheet and thereby stain the layer of the transfer dye B. This signifies that a process of this type yields prints of poor quality if printing proceeds to a second sheet and further thereon after printing the first sheet.

(3) The ink sheet which occupies a large volume is a great obstacle for implementing a compact printer device.

(4) Image transfer in a so-called thermal transfer printing method is based on the thermal transfer phenomena of a dye. Accordingly, the image receiving layer must be heated sufficiently to diffuse the dye inside the image receiving layer of the image transfer body. This impairs the thermal efficiency of the process.

(5) To efficiently transfer the image, the ink sheet must be pressed against the transfer body by applying a high pressure. This inevitably requires a printer of high mechanical strength and poses a great hindrance in realizing a compact and light weight printer device.

(6) The sensitivity of image transfer can be improved by increasing the miscibility of the dye receiving resin and the image transfer dye. However, in general, a dye receiving resin that is highly miscible with the image transfer dye has poor preservation stability, and particularly, is inferior in light stability.

As described in the foregoing, a so-called thermal transfer method is subject to various problems. It has been therefore required to develop a technology for implementing a compact and light weight printer while reducing wastes and the consumption of transfer energy, yet making full use of the aforementioned advantages of the thermal transfer recording method.

In the light of the aforementioned circumstances, the present inventors have extensively conducted a study for implementing a thermal recording method which meets to the present demand. As a result, the present inventors have successfully developed a recording technique as illustrated in FIG. 34.

Referring to FIG. 34, minute interstice is provided between a recording unit having a thermally fusible dye layer and a recording body 50 having a dye receiving layer faced to the recording unit. Then, a liquefied dye 22 on the recording unit is vaporized selectively using a proper heating means such as a laser L, and is transferred through the interstice to form an image having a continuous gradation on the recording body 50. This procedure is repeated on each of the image signals obtained by separating the initial image signal into the three subtractive primaries, i.e., yellow, magenta, and cyan. In this manner, a full-color image having a continuous gradation can be obtained.

In this recording method, preferably, the recording body 50 is faced to the upper side of the recording unit so that the laser beam L might be focused in the vicinity of the upper face of a vaporizing portion 67. In this manner, the vaporized dye 32 can be moved upward. If this were to be effected in a reversed manner, i.e., if the laser beam were to be focused in the vicinity of the lower face of the vaporizing portion to allow the recording portion and the vaporized dye located in the lower side to move, the liquefied dye would generate a convection in the vaporizing portion to impair the thermal efficiency.

According to the method of the present invention, the dye which is consumed for the recording is almost free of a binder resin. Thus, the dye can be supplied continuously to the recording portion by flowing the dye from the dye reservoir in a fused state at a quantity corresponding exactly to the consumed amount, or by continuously applying the dye to a proper base which is transferred to the recording portion. The recording portion can be thus subjected to repeated use, and the problem (1) as mentioned in the foregoing can be overcome by principle in this manner.

In the method according to the present invention, the dye layer is not in direct contact with the recording body. Thus, the problem (2) of impairing the image due to back transfer of the recording dye previously transferred to the recording body to a layer of a differing dye can be solved. At the same time, the problem (3) of making the printer device light weight and compact can be coped with by thus eliminating the ink sheet and by using a small dye reservoir for supplying the dye.

The recording method according to the present invention comprises a recording mechanism based on the vaporization of the dye. Accordingly, it is not necessary to heat the image receiving layer nor for the ink sheet to be pressed against the transfer body by applying a high pressure. Thus, the problems (4) and (5) can also be solved. Moreover, the recording portion and the recording body are not brought into direct contact with each other. This fact, by principle, not only excludes thermal fusion from occurring between the recording portion and the recording body, but also makes recording possible even when a dye less miscible with the resin in the image receiving layer is used. Thus, the dye and the resin for use in the receiving layer can be designed more freely and can be selected from a wider variety of materials to solve the problem (6).

With further investigation, however, it was found that the recording portion shown in FIG. 34 had yet the following problems to be overcome.

The laser beam is focused through a glass sheet 14 to generate heat. Thus, even when a dye containing an infrared absorbent is used, the dye in the vaporizing region must be confined to a thickness of several micrometers to generate the vapor of the dye. The fusible dye cannot be smoothly supplied to such a thinly confined region.

Moreover, if bumping occurs on the liquefied dye, not only a favorable recording is obtained, but also a cavity 68 illustrated with a virtual line in FIG. 34 forms due to the bumping. Because the liquefied dye cannot be replenished immediately due to its high viscosity, a defective portion results in the recorded image due to the cavity 68.

SUMMARY OF THE INVENTION

Thus, the present invention has been accomplished in the light of the aforementioned circumstances. An object of the present invention is to provide a recording unit structure and a recording device which assure a recording of excellent quality, yet made compact and light weight, which yield a high thermal efficiency, and which produce no used ink sheets and other wastes.

The object of the present invention is accomplished in one aspect by a recording unit structure comprising a recording material layer faced to a recording body with a space incorporated therebetween, so that said recording material might be vaporized and transferred to said recording body through said space, provided that pores are provided to the vaporizing portion of the recording material in such a manner that the pores be present within the layer of the recording material.

Preferably in another aspect according to the present invention, the pores are communicating pores which extend from the inside of the recording material to the surface of the layer of the recording material facing to the recording body.

Preferably in a still other aspect according to the present invention, a structure having communicating pores is provided on the inner plane corresponding to the bottom plane of the recording material layer.

Preferably in another aspect according to the present invention, the communicating pores are formed by using an aggregate of a plurality of fine particles.

According to a yet other aspect of the present invention, the communicating pores can be formed by means of photolithography.

According to a further other aspect of the present invention, the communicating pores can be formed by using a plurality of fibrous bodies.

According to a still yet other aspect of the present invention, the communicating pores can be formed by using a porous material.

Preferably in another aspect of the present invention, the structure comprising the communicating pores has a coating on at least the surface to which the communicating pores are provided.

Preferably in a still other aspect of the present invention, a coating is provided to at least a portion of the surface of the recording material to which the communicating pores are connected.

Preferably in a yet other aspect of the present invention, the coating layer preferably comprises a metal which absorbs infrared radiation.

Preferably in a still yet other aspect of the present invention, the coating layer preferably comprises a heat insulating material or a reflection preventive material.

Preferably in a further other aspect of the present invention, a layer of a heat insulating material is formed on the inner plane of a vaporizing portion corresponding to the bottom portion of the recording material layer.

According to an aspect of the present invention, the communicating pores may be varied in size and/or distributed without being equally spaced.

Preferably in a further other aspect of the present invention, the pores are from 0.01 to 3 μm in average pore diameter.

According to another aspect of the present invention comprising pores from 0.01 to 3 μm in average pore diameter, the pores may be formed in such a manner that they may be present in at least a part of a pore-forming body such as fine grains about 5 μm in average diameter.

Preferably in a still other aspect of the present invention, a dye comprising a light absorbing agent is used as the recording material.

The object of the present invention can be fulfilled in another aspect by a recording device comprising any of the recording unit structures described in the foregoing.

Preferably in a recording device according to one aspect of the present invention, a recording material is faced to a recording body with a space incorporated therebetween to vaporize the recording material and to transfer the recording material to said recording body, provided that a heating means for transferring a recording material through the space.

In a recording device according to a still other aspect of the present invention comprising a heating means, the heating means comprises a laser and a laser absorbing body which absorbs the laser light emitted from the laser.

In a recording device according to a yet other aspect of the present invention, a dye is vaporized by irradiating an energy beam thereto, and the vaporized dye is supplied to a recording body to form a printed image.

DESCRIPTION OF THE PREFERRED EMBODIMENTS

The present invention is described in further detail below referring to the preferred embodiments according to the present invention. It should be understood, however, that the present invention is not to be construed as being limited to the examples below.

Figure 1:
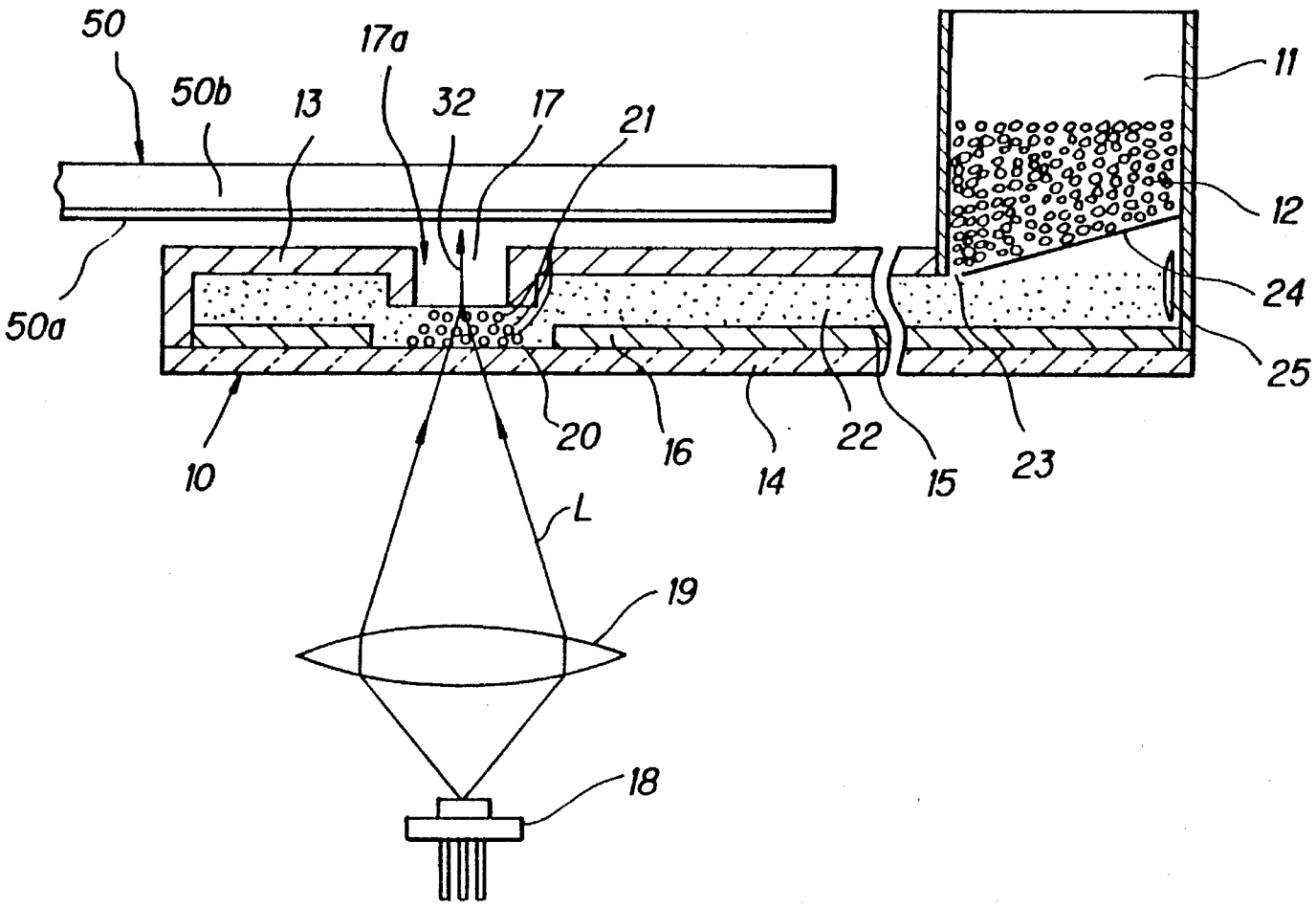
FIG. 1 is a schematically drawn cross section view of the recording unit of a recording device according to an embodiment of the present invention.
Figure 2:
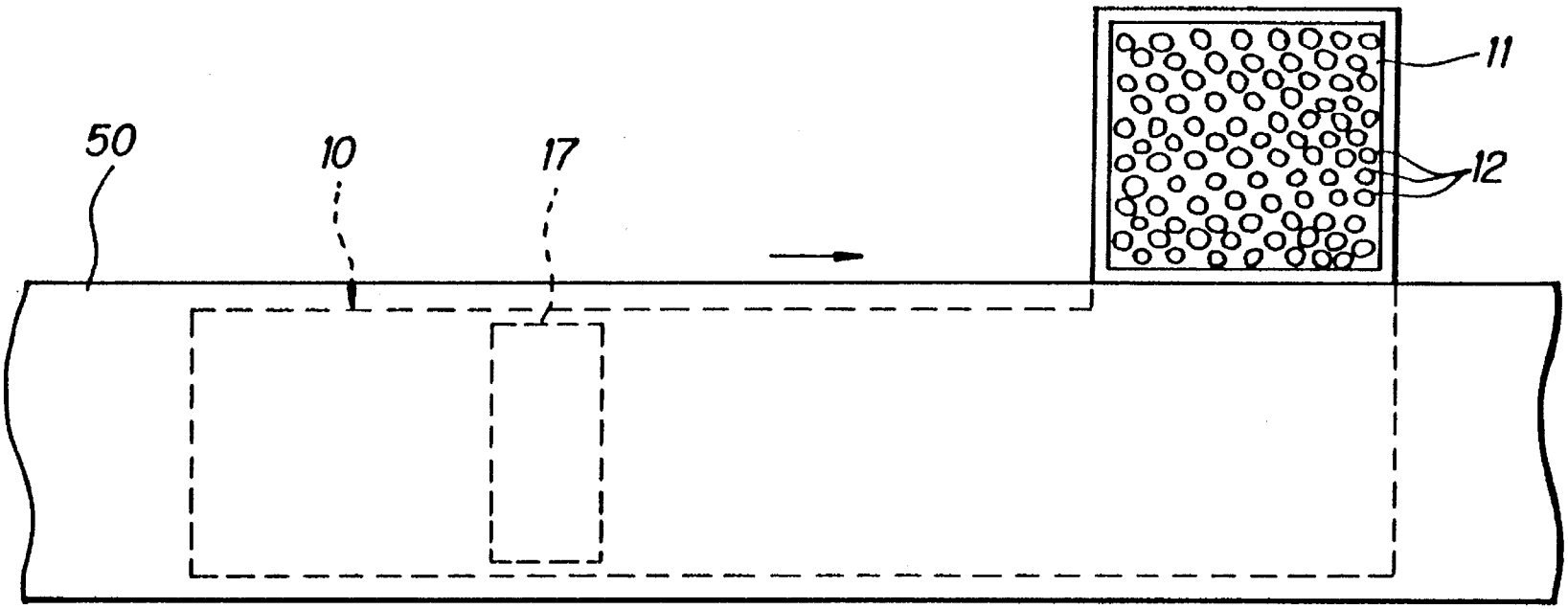
FIG. 2 is a schematically drawn plan view of the recording unit of a recording device according to an embodiment of the present invention, corresponding to FIG. 1.
Figure 3:
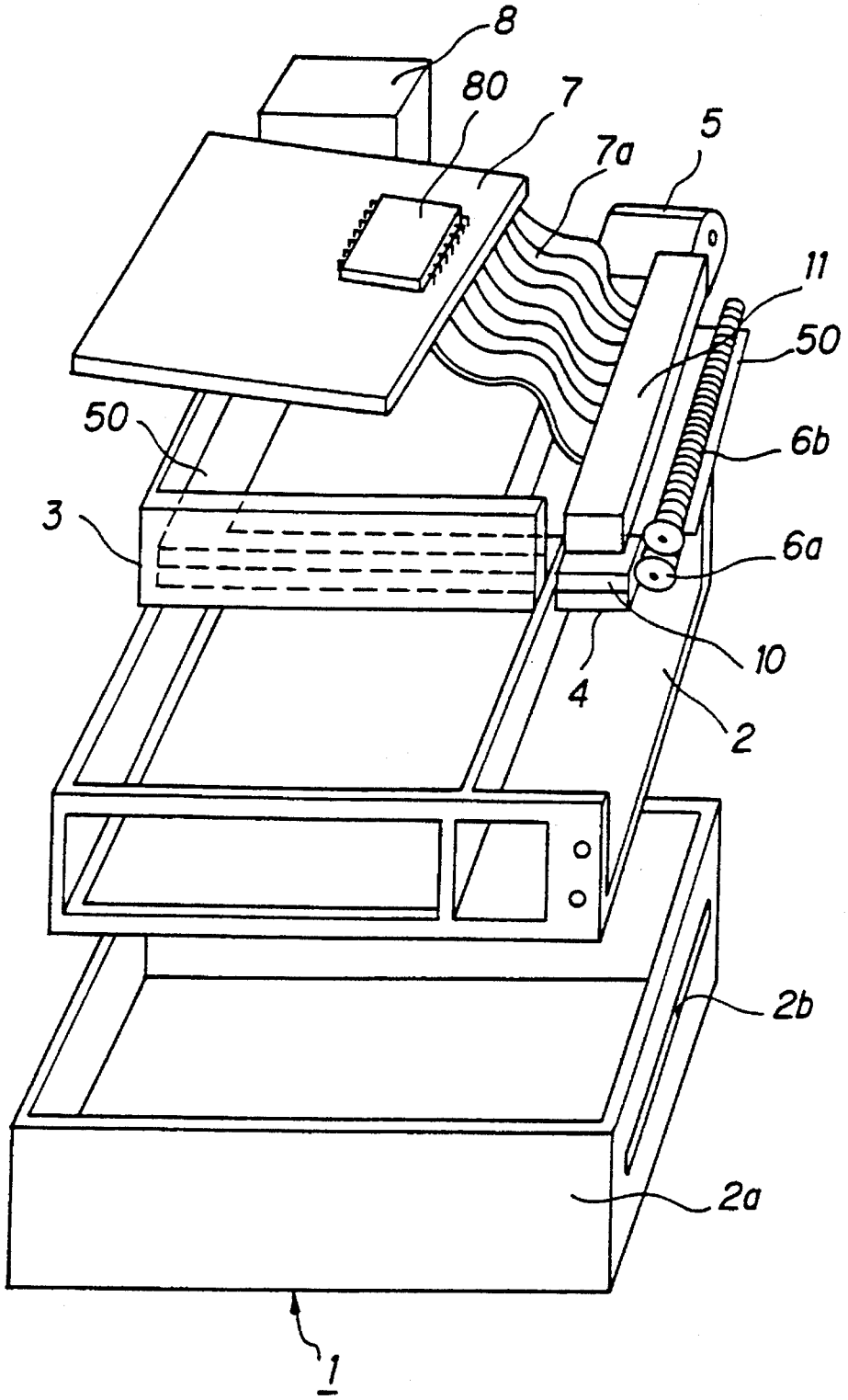
FIG. 3 is an exploded perspective view of the recording unit of a recording device according to an embodiment of the present invention, corresponding to FIG. 1.
Figure 4:
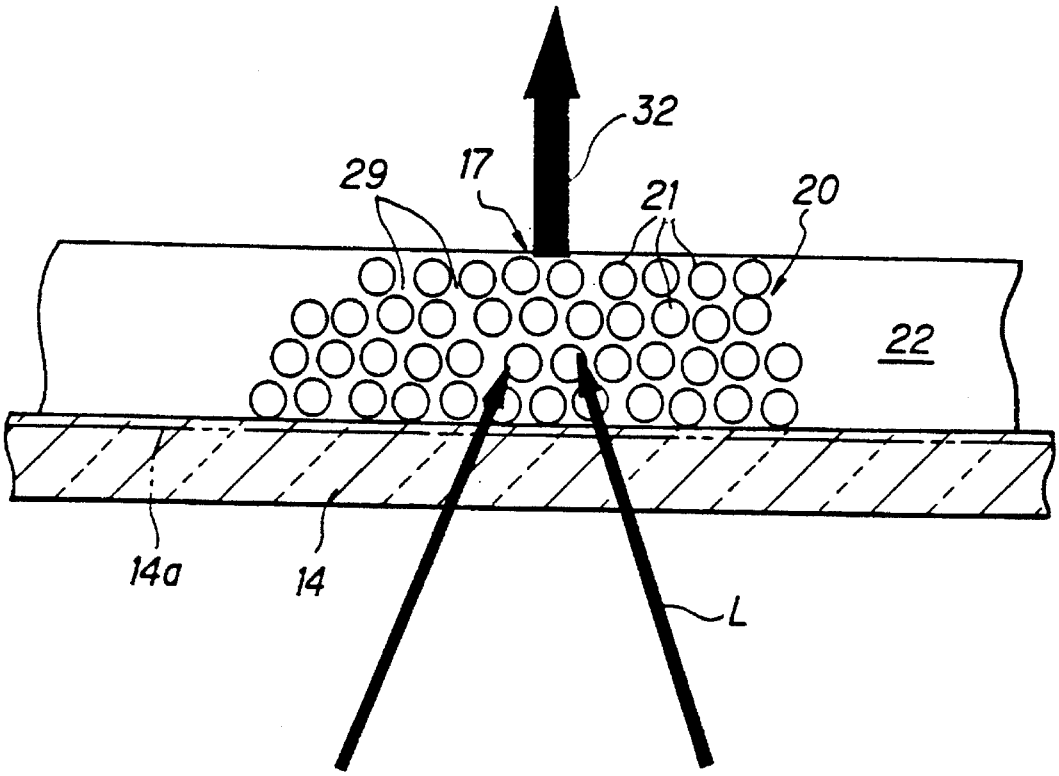
FIG. 4 is an enlarged cross section view showing the vaporizing portion of a recording device according to an embodiment of the present invention as illustrated in FIG. 1.

FIG. 1 shows the cross section view of the recording unit, FIG. 2 shows the schematic plan view of the recording unit corresponding to FIG. 1, FIG. 3 is an exploded perspective view of the recording device, and FIG. 4 is an enlarged cross section view of a part of the unit shown in FIG. 1. Referring first to FIGS. 3 and 4, the recording mechanism according to an embodiment of the present invention is described below.

Referring to FIG. 3, a laser-vaporizing color video printer (laser-vaporizing printer) 1 comprises a frame chassis 2 covered with a frame 2*a*, and a planar base 4 for recording provided thereon, together with a cassette 3 for placing therein the recording paper 50.

The outlet 2*b* for discharging the recording paper inside the frame 2*a* comprises a paper feed live roller 6*a* driven by a motor 5 and the like, and a slave roller 6*b* which holds the recording paper 50 by lightly pressing the paper against the paper feed live roller 6*a*. A head driver circuit board 7 mounted thereon a driver IC is provided together with a DC power supply 8 on the upper side of the cassette 3 placed inside the frame 2*a*. The head driver circuit board 7 is connected to the head unit (recording unit) 10 placed on the planar base 4 via a flexible harness 7*a*.

The head unit 10 comprises: dye storage cells (indicated collectively with numeral 11) for storing each of the sublimable solid dyes, i.e., yellow (Y), magenta (M), and cyan (C) dyes, in the form of solid powder (referred to collectively with numeral 12); liquefied dye reservoirs 15 in the form of a narrow path formed between the dye storage cells and a glass bottom plate 14 placed thereunder, said reservoirs provided for storing each of the liquefied dyes obtained by heating and fusing the thermofusible dyes 12 stored in each of said dye storage cells 11 using a heater 16 comprising an electric resistor attached to the glass bottom plate 14; vaporizing portions 17 each provided for each of the liquefied dye 22 introduced from each of the liquefied dye reservoir 15; and a semiconductor laser chip (laser light source) 18 and a condenser lens 19 provided to the head base 14 using a support disk (not shown in the figure) to irradiate a laser beam L to each of the vaporizing portions 17.

An aggregate 20 of plastic beads 21 is placed inside a vaporizing hole 17*a* (formed by the opening provided to the lid plate 13) provided to each of the vaporizing portions 17 to hold the liquefied dye 22 inside the hole 17*a*. The beads 21 are dispersed in a solvent on the bottom plate 14 in the step of assembling the head unit 10, and the solvent is dried thereafter to fix the beads on the bottom plate 14.

The beads 21 used herein are such from 5 to 10 μm in diameter. The heater 16 is provided for heating and liquefying the thermofusible dye 12 to transfer the liquefied dye to the bead aggregate 20 by diffusion.

The recording paper 50 inside the cassette 3 of the laser-vaporizing color video printer 1 is taken up one sheet at a time, and the sheet of paper is fed onto the head unit 10. The sheet of recording paper is then transferred to the paper feed live roller 6*a*. The head unit 10 comprises a plurality of semiconductor laser chips 18 corresponding to the number of pixels are arranged in three arrays each assigned to the three primaries (Y, M, and C). Each of the liquefied dyes corresponding to the three primaries Y, M, and C is heated and fused in each of the dye storage cells 11, and a predetermined quantity thereof is supplied to each of the vaporizing portions 17.

That is, each of the thermofusible dyes 12 in the form of solid powder stored inside the dye storage cells 11 is heated to the melting point and fused (liquefied) by the heater 16, and each of the liquefied dyes 22 is then supplied at a predetermined quantity up to the upper surface of the bead aggregate 20 provided inside the vaporizing hole 17*a* of each of the vaporizing portions by taking advantage of the nature of bead aggregate 20 of beads which exerts capillary phenomenon. Thus, by supplying a sheet of recording paper 50 between the paper feed live roller 6*a* and the slave roller 6*b* at this state, 1-dot signal for each of the primaries per line is sent to the head unit 10 to converge the laser light L generated from each of the semiconductor laser chips 18 in the vicinity of the upper surface of the bead aggregate 20.

Each of the liquefied dyes 22 held in each of the beads 21 is then vaporized so that each of the vaporized dyes (vaporized and dispersed dyes) 32 corresponding to the primaries Y, M, and C is transferred in the same order to the receptor layer 50*a* provided on the surface of the thus fed recording paper 50. A color printed image can be obtained in this manner.

Referring to FIG. 1, the recording unit comprises a head unit 10 for use in a laser-vaporizing color video printer 1.

A check valve 24 is provided to each of the connection port 23 between each of the solid dye storage cells 11 and each of the liquefied dye reservoirs 15. Furthermore, at the portion located faced to the vaporizing portion 17 inside each of the liquefied dye reservoirs 15, a means for feeding the dye under pressure (for instance, a vibrator) 25 for supplying the liquefied dye 22 under pressure is provided on the side of the vaporizing portion 17. The means for feeding the dye under pressure 25 is made of, for example, a bimorph cell or a piezoelectric element, however, is not always necessary. The check valve 24 shuts the connection port 23 in case a pressure is applied to the means for feeding the dye under pressure 25, and opens the connection port 23 when no pressure or reduced pressure is applied to the same means 25.

Each of the sublimable dyes 12 in the form of a solid powder stored inside the solid dye storage cells 11 is heated and liquefied by the heater 16 in case the check valve 24 is released to provide a liquefied dye 22, and is stored inside each of the liquefied dye reservoirs 15.

According to the laser-vaporizing type color video printer 1 described in the foregoing, the thermofusible dyes 12 in the form of a solid powder stored inside each of the solid dye storage cells 11 are heated by the heater 16 to the melting point thereof to provide a melt (liquid). Each of the liquefied dyes 22 obtained in this manner is supplied to the upper surface of the bead aggregate 20 placed inside the vaporizing hole 17*a* of each of the vaporizing portions 17 by means of the means for feeding the dye under pressure 25 and by taking advantage of capillary effect exerted by the aggregate of beads.

Then, a color printing is obtained on a sheet of a recording paper 50 by sending 1-dot signal for each of the primaries per line to the head unit 10 to heat the liquefied dye supplied to the upper surface of the bead aggregate by means of a laser light L generated from each of the semiconductor laser chips 18. Each of the liquefied dyes 22 held on each of the bead aggregate 20 is thus vaporized, and each of the vaporized and dispersed dyes 32 corresponding to the primaries Y, M, and C is transferred in this order to the receptor layer 50*a* of the recording paper 50 supplied to the upper side of the vaporizing portion 17 to provide a color printed image.

As described in the foregoing, the liquefied dyes 22 can be sent out and supplied at a high speed to the bead aggregate 20 by thus lightly applying a proper pressure to each of the liquefied dyes 22 inside each of the liquefied dye reservoirs 15. This is made possible by providing a vibrator 25 inside each of the liquefied dye reservoirs 15. Furthermore, the check valve 24 provided at the connection port 23 between the liquefied dye reservoirs 15 and the solid dye storage cells 11 surely prevents the back flow of the liquefied dyes 22 from the liquefied dye reservoirs 15 into the solid dye storage cells 11 from occurring.

Furthermore, the heater 16 provided in the liquefied dye reservoirs 15 maintains the liquefied dye 22 in a liquefied state by constantly heating the dye 22 inside the reservoirs 15.

The dyes which can be vaporized and transferred onto a recording body and hence usable in the present invention are such which yield a vapor pressure of 0.01 Pa within a certain temperature range between 25° C. and the decomposition temperature thereof. In case the dye molecules are associated in vapor phase at an average association number of n, the quotient obtained by dividing the vapor pressure above with the average association number n must be 0.01 Pa or higher. Examples of the commercially available dyes which fulfill the requirement above include those produced by Mitsui Toatsu Chemicals, Inc., i.e., Sudan Red 7B, tricyanostyryl magenta dye (a magenta dye), ESC-155 (a yellow dye), and ESC-655 (a cyan dye).

In the present embodiment, an aluminum-potassium-arsenic based semiconductor laser chip is used as the laser light source 18 to converge the laser light L at a high output in the vicinity of the upper surface of the bead aggregate 20. The laser beam is converged using a lens 19. The vaporizing portion 17 comprises an aggregate of plastic beads (spheres) about several micrometers in diameter. The liquefied dye is supplied continuously to the upper surface of the bead aggregate by making use of capillary phenomena; i.e., the liquefied dye proceeds upward through the narrow paths (communicating pores each about 1 μm in diameter) 29 formed between the beads 21. During its upward move to the surface of the beads, the dye absorbs the infrared component of the laser light.

The use of a laser radiation as a heating beam is advantageous not only from the viewpoint of greatly increasing the resolution, but also from that of improving the thermal efficiency. More specifically, a concentrated heating of the liquefied dye is possible by increasing the laser light density using an optics (lens). The temperature achievable by laser heating can be elevated in this manner. In particular, the use of a multi-laser array greatly speeds up the recording, because it shortens the time necessary for recording an image plane.

As described in the foregoing, a recording unit according to the present invention enables, for the first time, restricting the supply region for vaporizing liquefied dyes to a thickness of a mere several micrometers, and yet supplying smoothly the liquefied dyes to this supply region. As a result, a favorable recording can be effected using the vaporized and dispersed dyes 32 without causing bumping. Furthermore, the thermal efficiency of the thermal transfer recording according to the present invention is improved by about five times as compared with that of a conventional thermal transfer recording using resistance heating.

Preferably, as shown with a virtual line (a series of two dots and a dash) in FIG. 4, a layer 14*a* of a heat insulating material is provided on the upper surface of the bottom plate 14 to more efficiently heat the dye using a heater 16 and a laser light L while preventing heat diffusion from occurring on the dye. Polyimide resin is preferred as the heat insulating material for the layer 14*a*.

In the embodiment according to the present invention described above, the liquefied dye is vaporized by means of laser irradiation alone. However, the efficiency of vaporization can be improved by also using a laser-absorbing substance. A preferred laser-absorbing substance (a photothermal conversion substance) may be a thin film of a metal or a laminate of a metallic thin film and a thin film of a ceramic having a high dielectric constant, provided that it has a sufficiently high thermal resistance for continuously absorbing a laser light, and that it absorbs light of a wavelength corresponding to that of the laser radiation.

The laser-absorbing substance can be added into the dye. For instance, about 2 parts by weight of a cyanine-based light absorbing agent may be added to 100 parts by weight of the dye to improve the photothermal conversion efficiency. Other usable light absorbing agents include heat-resistant dyes or pigments, for example, fine-grained light absorbers such as carbon black and fine-grained metals; organic coloring matter such as phthalocyanine dyes, naphthalocyanine dyes, and anthraquinone dyes; as well as organometallic coloring matters. In case these dyes or pigments are used, they are uniformly dispersed in the dye.

Figure 5:
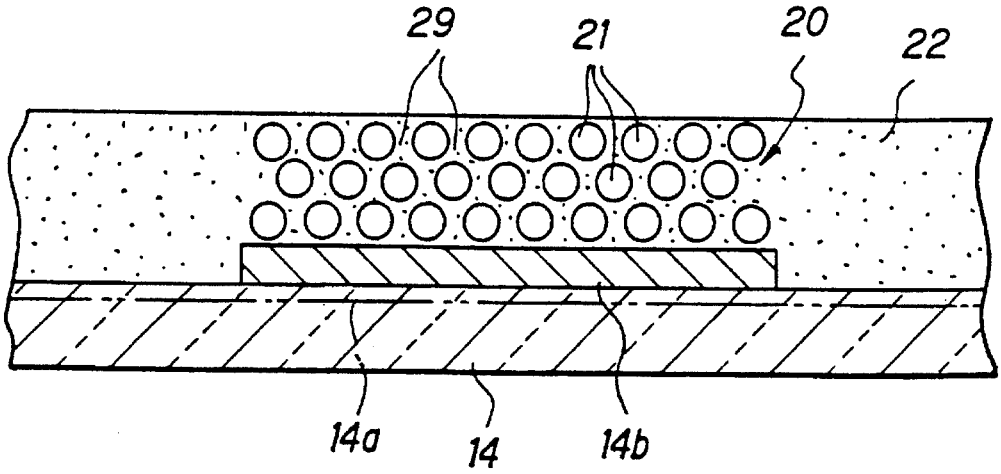
FIG. 5 is an enlarged cross section view showing the vaporizing portion of a recording device according to another embodiment of the present invention.

Furthermore, the liquefied dye can be more efficiently vaporized using the laser beam by vapor depositing a photothermal conversion layer 14*b* on the bottom plate 14 and settling the beads 21 thereon as shown in FIG. 5. A cobalt-nickel alloy is preferred as the material for use in the photothermal conversion layer 14*b*.

Figure 6:
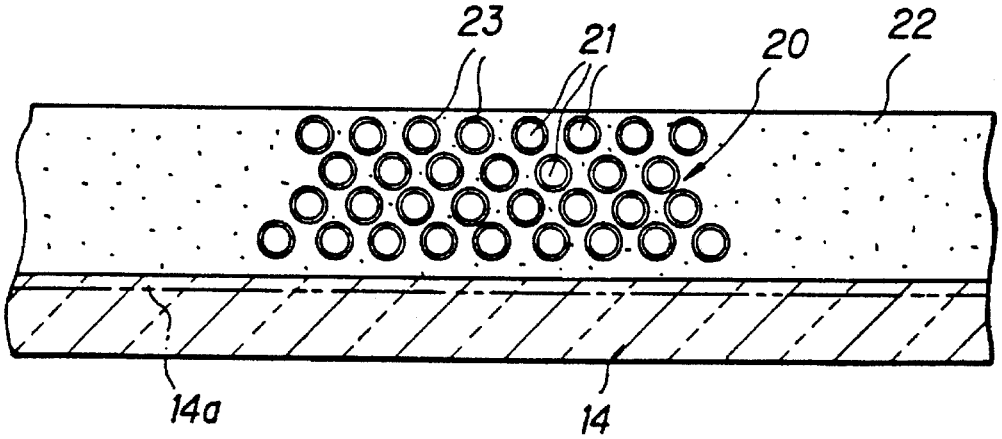
FIG. 6 is an enlarged cross section view showing the vaporizing portion of a recording device according to a still other embodiment of the present invention.

A case of coating each of the beads with an anti-reflection film is illustrated in FIG. 6. Referring to FIG. 6, an amorphous silicon nitride film provided at a thickness corresponding to a quarter of the wavelength of the laser light is preferred for the anti-reflection film 23 provided on each of the beads 21. The reflection can be minimized and hence the energy efficiency can be maximized by thus providing an anti-reflection coating at a thickness corresponding to one-fourth of the wavelength of the laser light.

Figure 7:
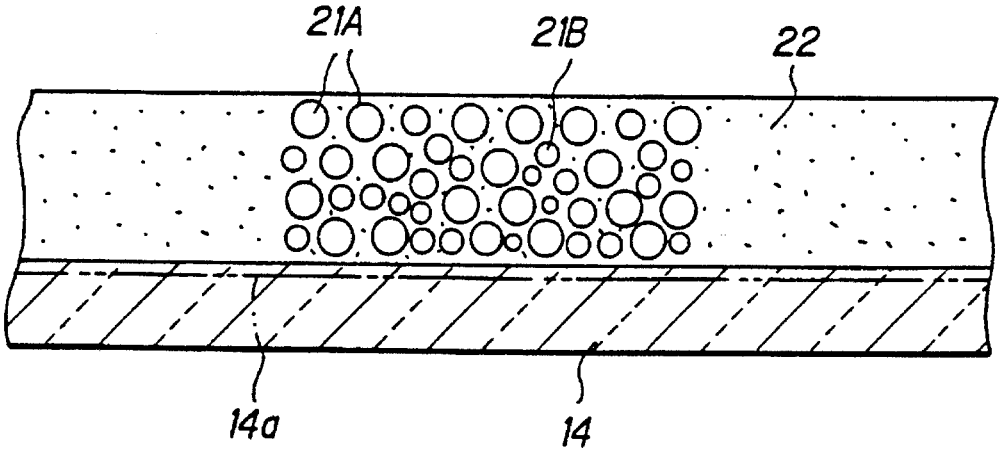
FIG. 7 is an enlarged cross section view showing the essential portion of the vaporizing portion of a recording device according to a yet other embodiment of the present invention.

In the case illustrated in FIG. 4, beads 21 substantially uniform in size are provided in the liquefied dye. However, as illustrated in FIG. 7, the beads need not be of the same size, and beads 21B relatively small in size can be arranged in the interstices among the larger beads 21A. The beads can be fixed more stably by arranging them in this manner.

By vapor depositing a thin film of metal as an infrared absorber on the aggregate of beads, not only the photothermal conversion efficiency increases, but also the beads are stabilized. Examples of the preferred metals for use in the vapor deposition include titanium, iron, nickel, and chromium. The thin film of a metal is deposited to a thickness of about 500 Å.

Figure 8A:
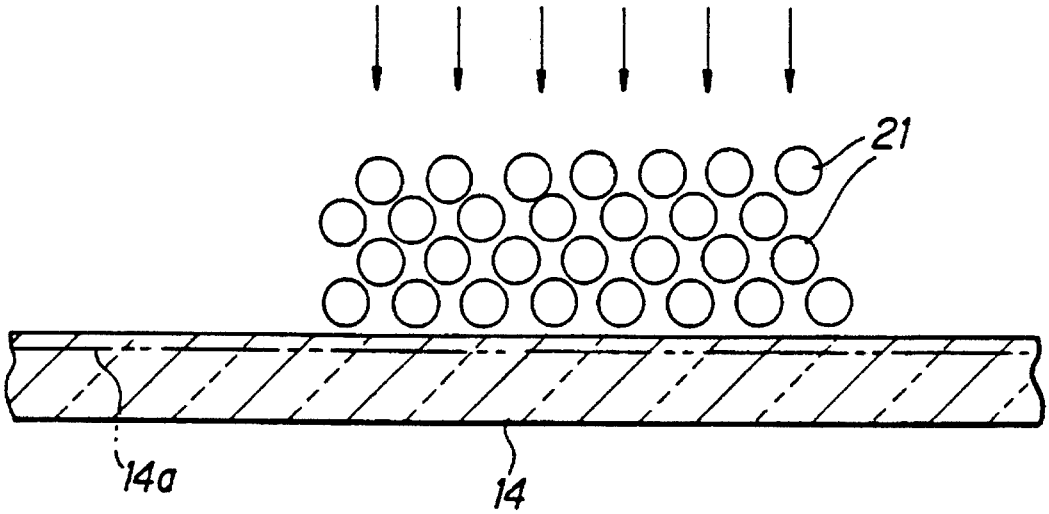
FIGS. 8 (*a*) and 8 (*b*) are each enlarged cross section views showing the essential portion of the vaporizing portion of a recording device according to a further other embodiment of the present invention, wherein FIG. 8 (*a*) illustrates the manner of vapor depositing an infrared-absorbing metal on beads, and FIG. 8 (*b*) illustrates beads having thereon a coating of the vapor deposited infrared-absorbing metal.
Figure 8B:
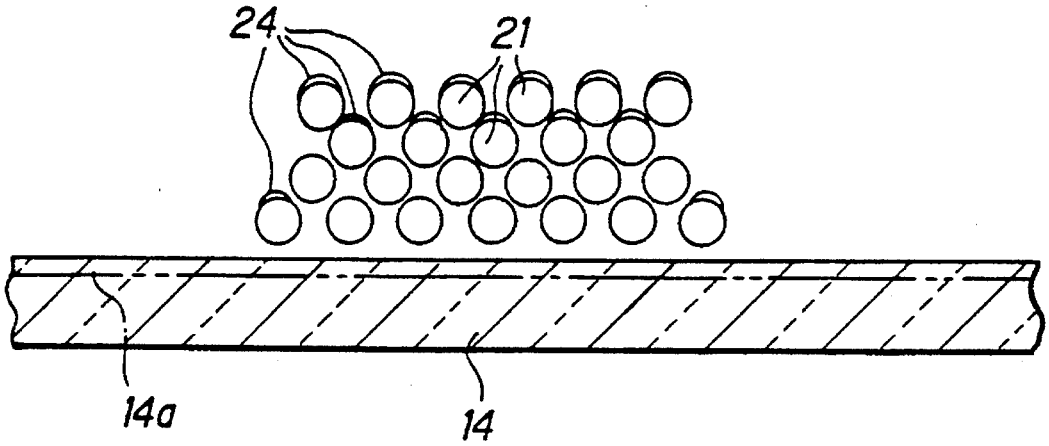

Referring to FIG. 8 (*a*), a metal layer is vapor deposited by supplying a vaporized metal from the upper side of the aggregate of the beads. FIG. 8 (*b*) shows the aggregate of beads 21 having thereon the vapor deposited thin film of metal 24 for use as an infrared absorber.

The foregoing embodiments refer to cases in which the liquefied dyes are supplied to the vaporizing region through the interstices among the bead aggregate. The method of supplying the liquefied dyes is not only restricted to those, and the liquefied dyes can be supplied to the vaporizing region via the interstices among the columns of small diameter.

Figure 9:
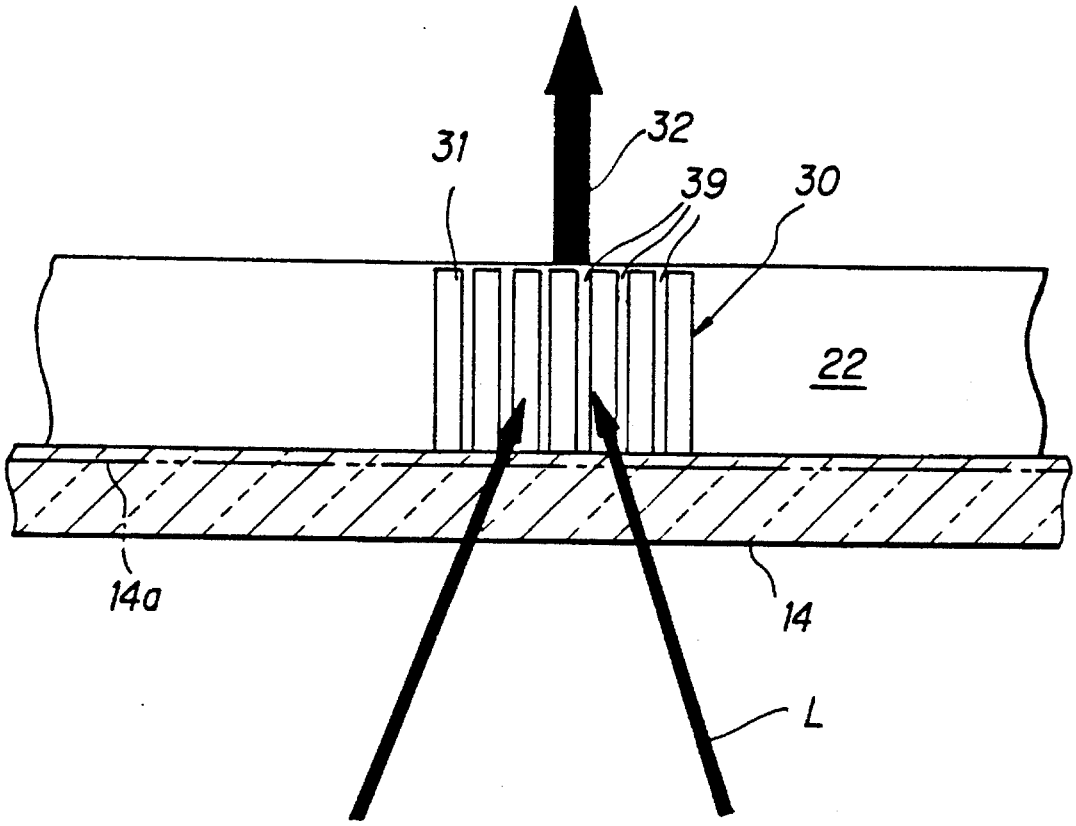
FIG. 9 is an enlarged cross section view showing the vaporizing portion of a recording device according to a still yet other embodiment of the present invention.

Referring to FIG. 9, an embodiment according to the present invention in which columns are used. Liquefied dyes 32 are transferred upward by capillary force through the interstices (communicating pores) 39 among columns 31 formed approximately perpendicular and integrated to the bottom plate 14. The liquefied dyes thus supplied to the upper side is vaporized by means of a laser light L to effect recording. The columns 31 provided perpendicular to the bottom plate 14 are provided taking a spacing of about 1 μm from each other, and are each about 3 μm in diameter with a thickness in the range of from 1 to 6 μm (the thicker, the better). The columns 31 are not confined to cylindrical columns, and may be in the form of square columns.

Figure 10A:
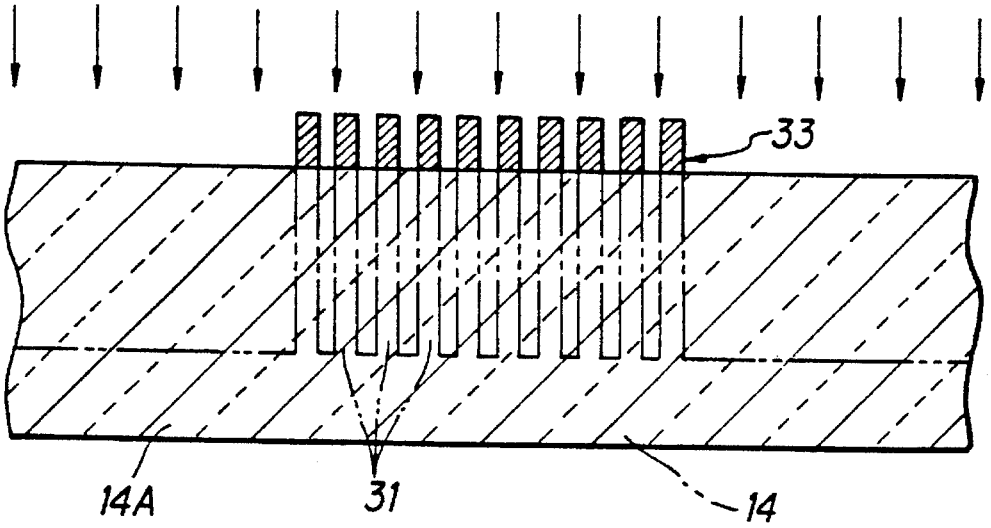
FIGS. 10 (*a*) and 10 (*b*) are each enlarged cross section views showing the formation of a columnar structure (columns), wherein, FIG. 10 (*a*) illustrates the process of forming the columnar structure (columns), and FIG. 10 (*b*) illustrates an already established columnar structure (columns)
Figure 10B:
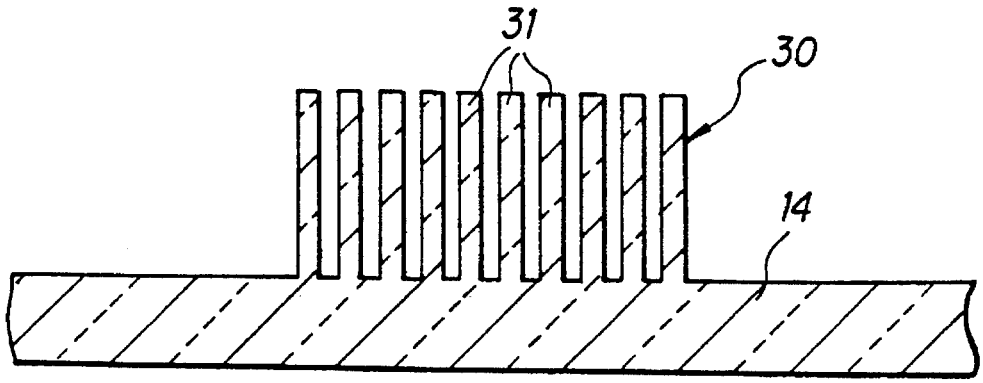

Referring to FIGS. 10 (*a*) and 10 (*b*), the process for fabricating the vaporizing portion illustrated in FIG. 9 is described below. Referring to FIG. 10 (*a*), a plurality of columns 31 are formed by reactive ion etching on a thick plate 4A of an amorphous silicon dioxide (quartz glass) having thereon a photomask 33. Because the interstices among the columns 31 and the periphery of the columnar aggregate 30 are not masked, the portions in the interstices among the columns and the periphery of the columns are etched to a thickness shown with a virtual line (a series of two dots and a dash) in FIG. 10 (*a*). Thus, columns 31 as illustrated in FIG. 10 (*b*) are obtained as a result. Because reactive ion etching is directional along the direction of gas supply, the portions in the interstices among the columns 31 are etched approximately perpendicular to the plane of the quartz glass bottom plate 14. The columns can be formed more easily by reactive ion etching as compared with the previous case in which bead aggregate is formed.

Figure 11:
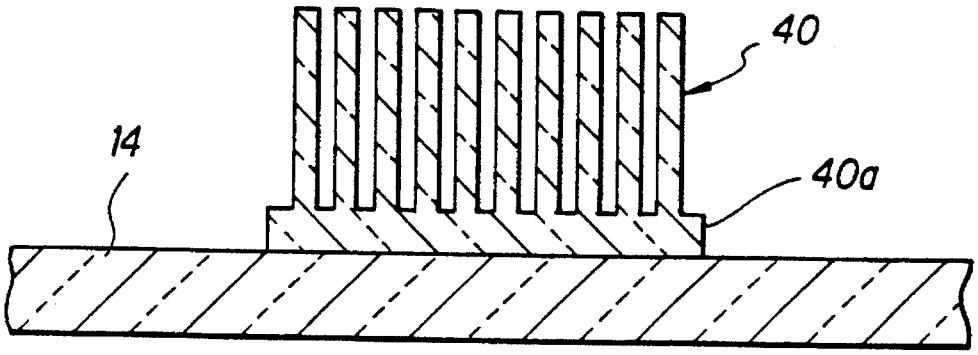
FIG. 11 is an enlarged cross section view showing the essential portion of the vaporizing portion of a recording device according to a further other embodiment of the present invention.

According to another embodiment referring to FIG. 11, a bottom plate of an ordinary thickness can be used, but a columnar aggregate 40 formed by reactive ion etching can be adhered to a bottom plate 14 by the common bottom wall 40*a* of the columnar aggregate.

Figure 12:
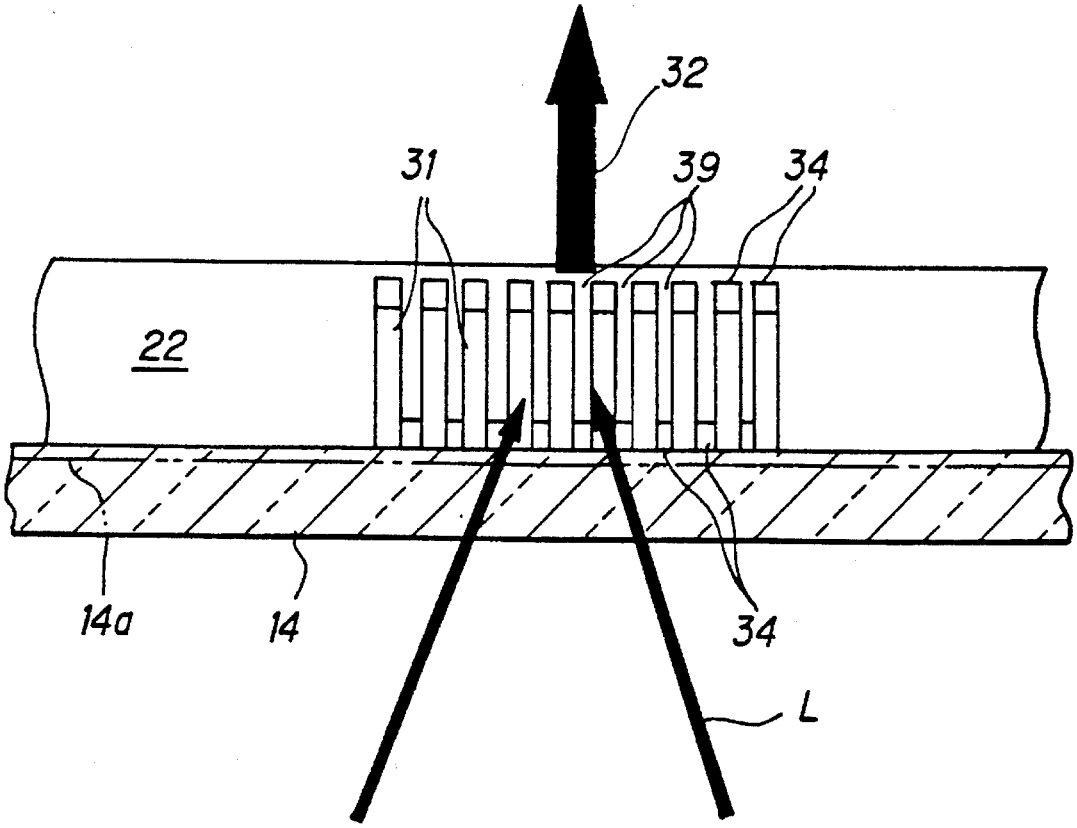
FIG. 12 is an enlarged cross section view showing the vaporizing portion of a recording device according to a further other embodiment of the present invention.

Referring to FIG. 12, a metallic vapor deposition layer 34 similar to that in the case with reference to FIG. 8 can be formed on the upper surface of each of the columns 31 as an infrared absorber. The laser power can be utilized more efficiently in this manner. A metallic vapor deposition layer 34 is also formed on the interstices among the columns 31 and on the bottom plate 14.

Figure 13:
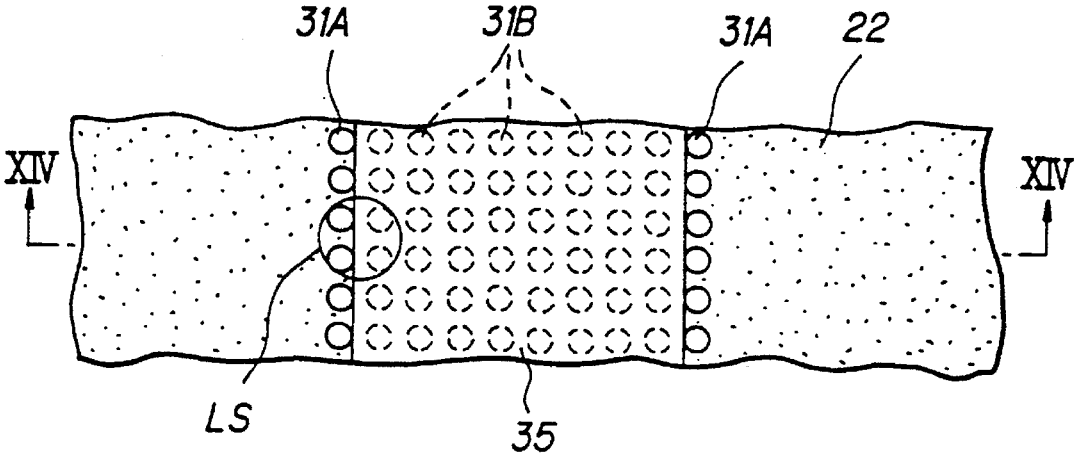
FIG. 13 is an enlarged cross section view showing the vaporizing portion of a recording device according to a yet other embodiment of the present invention.
Figure 14:
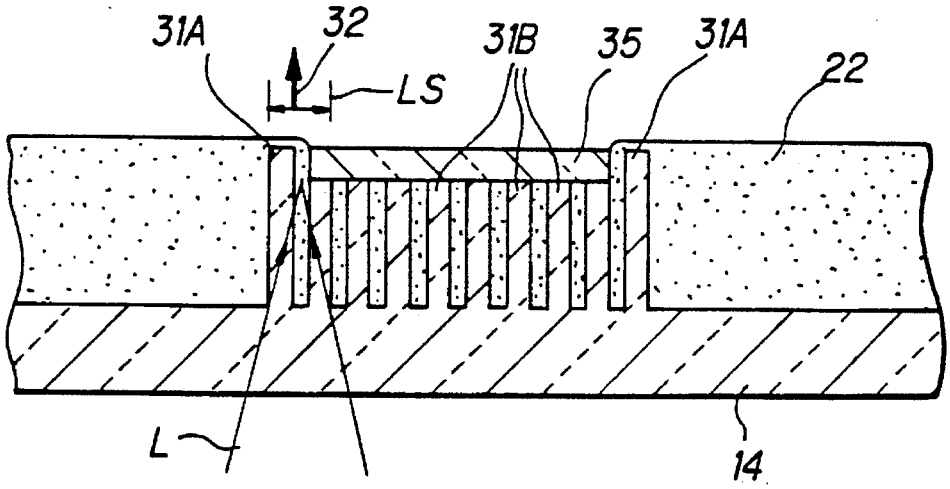
FIG. 14 is a cross section view taken along line XIV—XIV of FIG. 13.

Because the columnar aggregate with reference to FIG. 9 is connected to the bottom plate merely by the lower end of each of the columns, the mechanical strength of the entire structure is not sufficiently high. Thus, the structure can be mechanically reinforced by bridging the upper ends of the columns using a thin plate. FIG. 13 shows the plan view of the thus reinforced vaporizing portion, and FIG. 14 shows the cross section view of the same as viewed along line XIV—XIV of FIG. 13.

The columns are provided in such a manner that each of the columns 31B being sandwiched by two arrays 31A, one each provided on each of the sides, be slightly shorter than the height of the columns 31A provided on both sides. A thin plate 35 is adhered to the upper surface of the columns 31B in such a manner that the columns 31B be bridged by the thin plate 35 and that the height of the columns 31B with the plate 35 be equal to that of the columns 31A provided on both sides thereof. Then, laser light L is irradiated in such a manner that the beam spot LS be converged at the region bridging the plate 35 with the columns 31A arranged along the edges of the columns 31B.

In this manner, the columnar aggregate can be reinforced and, at the same time, the vaporized dyes can be transferred to the recording body (not shown in the figure) from the beam spot LS to which the laser light is converged.

Figure 15A:
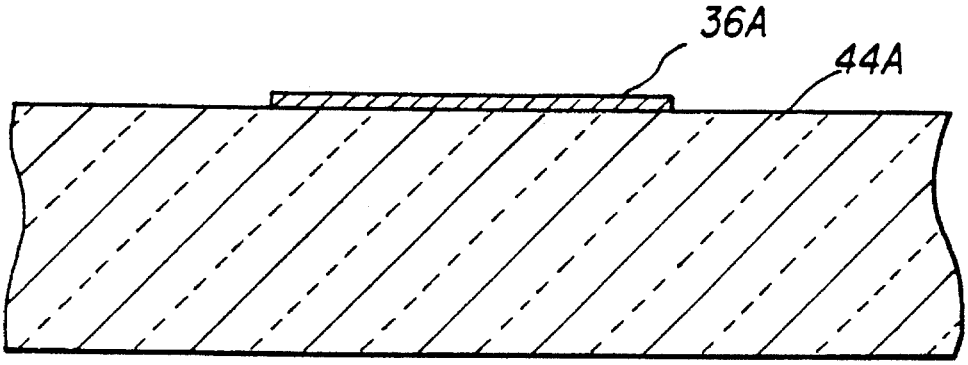
FIGS. 15 (*a*) to 15 (*c*) are each enlarged cross section views showing the essential portion of the vaporizing portion of a recording device according to a further other embodiment of the present invention, wherein FIG. 15 (*a*) shows the state before forming a columnar structure (columns), FIG. 15 (*b*) shows the manner of forming a columnar structure (columns), and FIG. 15 (*c*) shows an already established columnar structure (columns)
Figure 15B:
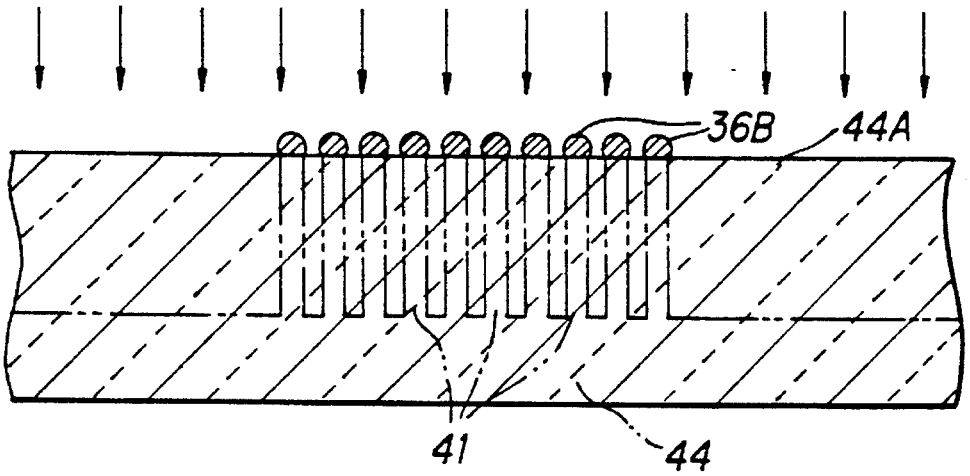
Figure 15C:
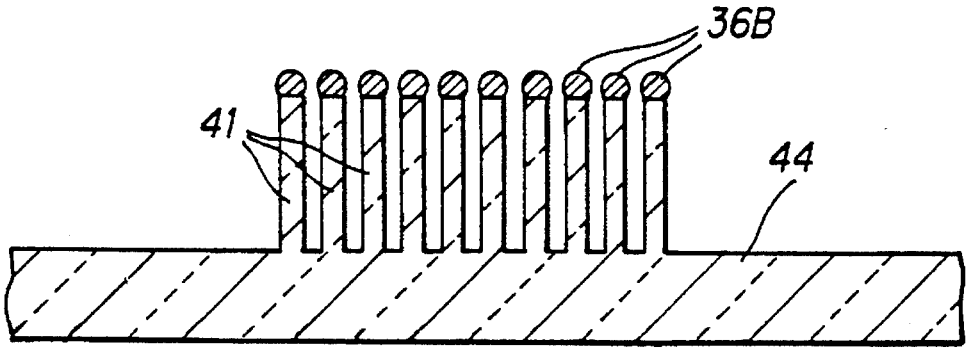

Referring to FIGS. 15 (*a*) to 15 (*c*), the process for forming the columns is described below.

Referring first to FIG. 15 (*a*), a thin film 36A of gold is formed at a thickness of from 50 to 100 nm on a thick plate 44A of a heat-resistant glass or silicon. Gold is chemically stable, has a low melting point, and poor wettability with respect to the plate 44A.

The plate 44A is heated to a temperature not lower than the melting point of gold to melt the thin film of gold 36A. Thus, as shown in FIG. 15 (*b*), super-fine balls 36B of gold are formed by the surface tension of the melt.

The resulting structure is then subjected to reactive ion etching in the same manner as in the case with reference to FIG. 10. Thus, referring to FIG. 15 (*c*), columns 41 are formed while the plate 44A illustrated in FIGS. 15 (*a*) and 15 (*b*) is etched to a predetermined thickness to provide a bottom plate 44.

Figure 16:
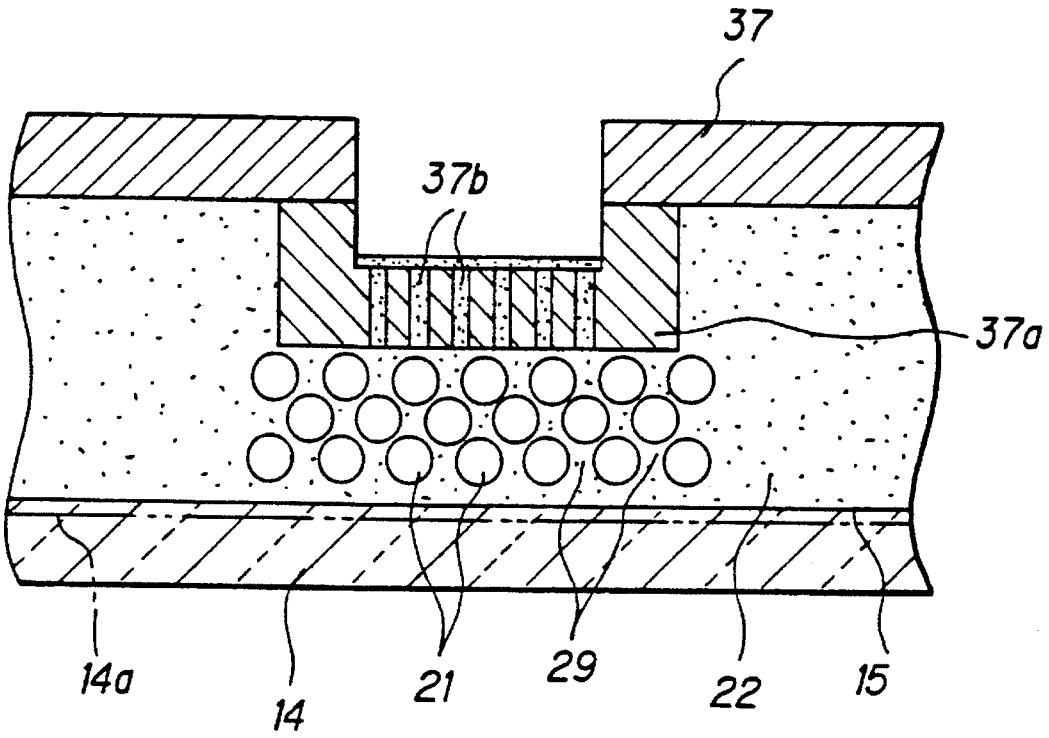
FIG. 16 is an enlarged cross section view showing the vaporizing portion of a recording device according to a yet other embodiment of the present invention.

Referring to FIG. 16, there is provided a case in which the lid plate 37 of the liquefied dye reservoir 15 is lowered at the vaporizing portion. It can be seen that a plurality of penetrating holes 37*b* are each provided at a small diameter to the lowered portion 37*a* of the lid plate, and that beads 21 are charged between the bottom plate 14 and the lowered portion 37*a* of the lid plate. The liquefied dye 22 moves upward through the interstices of the beads 21 and the penetrating holes 37*b* by the capillary force, and is vaporized by the laser light converged at the penetrating holes 37*b*. Thus, the vaporized dye is transferred to the recording body (not shown in the figure) provided on the upper side of the lid plate 37.

Figure 17:
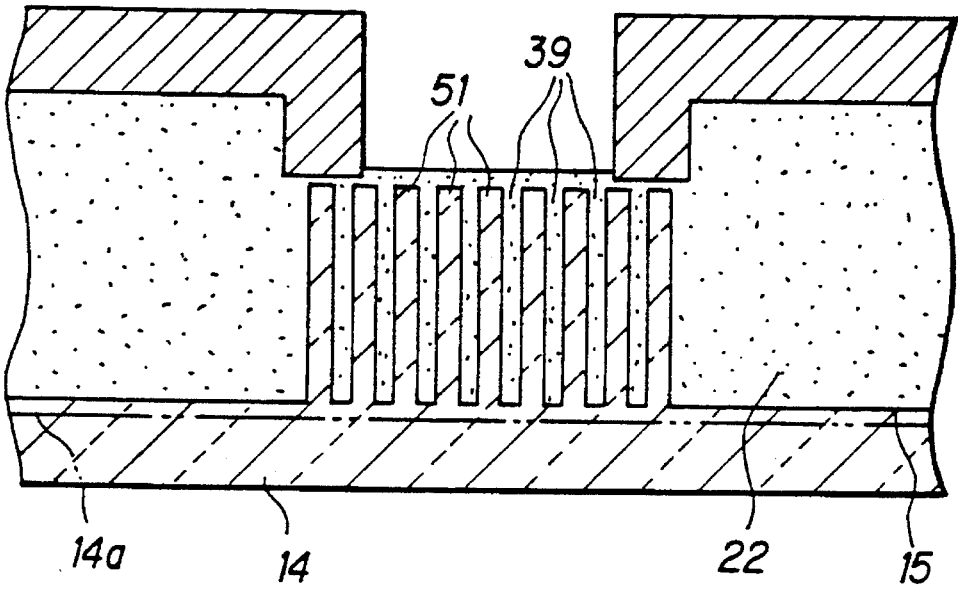
FIG. 17 is an enlarged cross section view showing the vaporizing portion of a recording device according to a still other embodiment of the present invention.

Referring to FIG. 17, another embodiment according to the present invention is described, in which the bottom plate of the liquefied dye reservoir 15 is integrated at the vaporizing portion with the columns 51. In this embodiment again, the liquefied dye 22 which moves upward through the interstices of the columns 51 is vaporized by the laser light converged in the vicinity of the upper end of the columns, and then transferred to the recording body (not shown in the figure) provided on the upper side of the columns.

Figure 18:
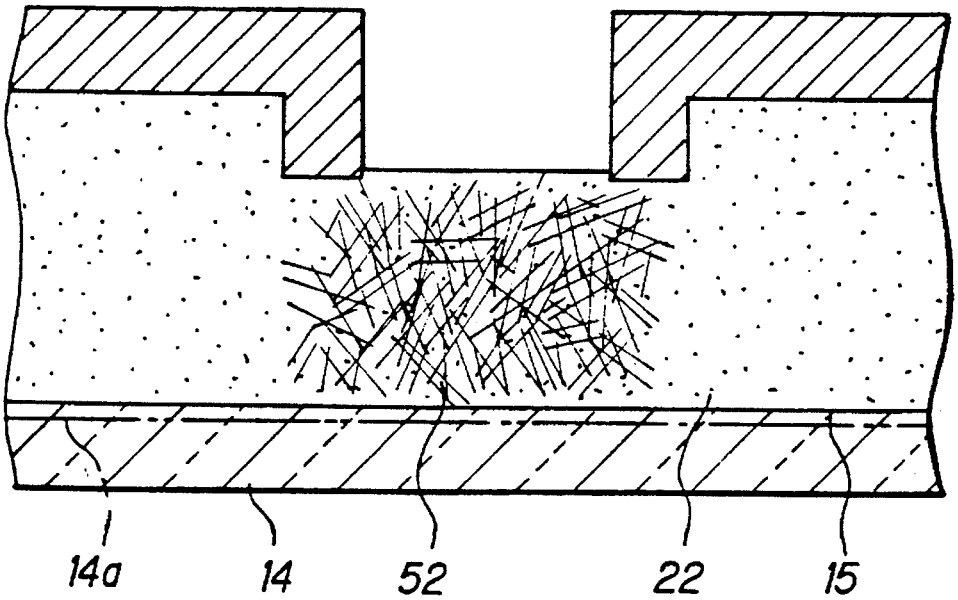
FIG. 18 is an enlarged cross section view showing the vaporizing portion of a recording device according to a still yet other embodiment of the present invention.

Referring to FIG. 18, a still other embodiment according to the present invention is described, in which metallic or quartz fibers are charged into the vaporizing portion. Preferred as the fibers 52 are whiskers and dendrites. Dendrites can be prepared by supercooling a melt to a temperature not higher than the melting point of the melt, and discharging the remaining melt while collecting the crystallized product. Again in this embodiment, the liquefied dye 22 moves upward the interstices among the fibers 52 according to capillary phenomena, and is vaporized by the laser light converged at the upper portion of the fiber aggregate. The vaporized dye is thus transferred to the recording body (not shown in the figure) provided at the upper side of the fiber aggregate.

Figure 19:
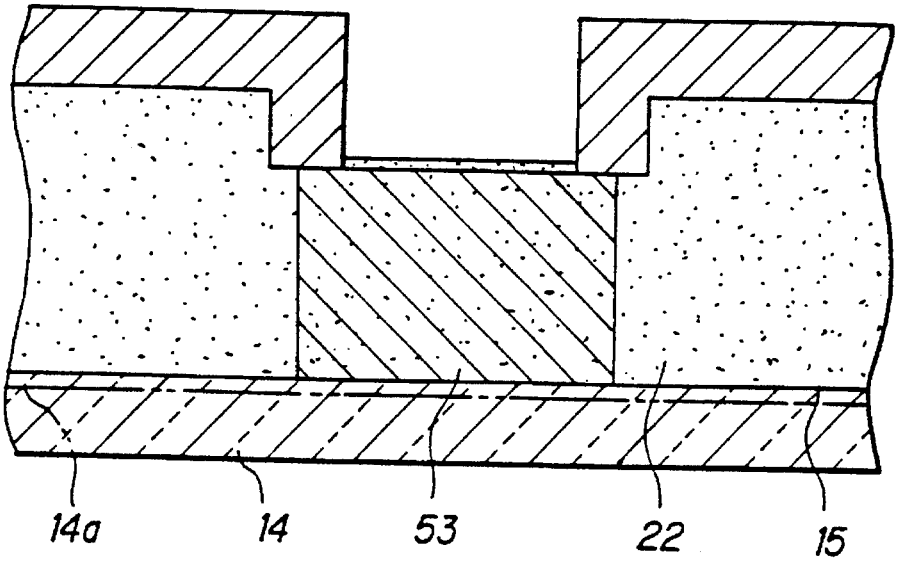
FIG. 19 is an enlarged cross section view showing the vaporizing portion of a recording device according to a further other embodiment of the present invention.

Referring to FIG. 19, a yet other embodiment according to the present invention is described, in which a porous article 53 comprising communicating pores is adhered to the bottom plate 14. Specifically mentioned as the porous article 53 are a naturally occurring pumice or a sintering (either metallic or ceramic) having a high porosity. Also in this embodiment, the liquefied dye 22 moves upward the communicating pores of the porous article 53 according to capillary phenomena, and is vaporized by the laser light converged at the upper portion of the porous article 53. The vaporized dye is then transferred to the recording body (not shown in the figure) provided at the upper side of the porous article.

Figure 20:
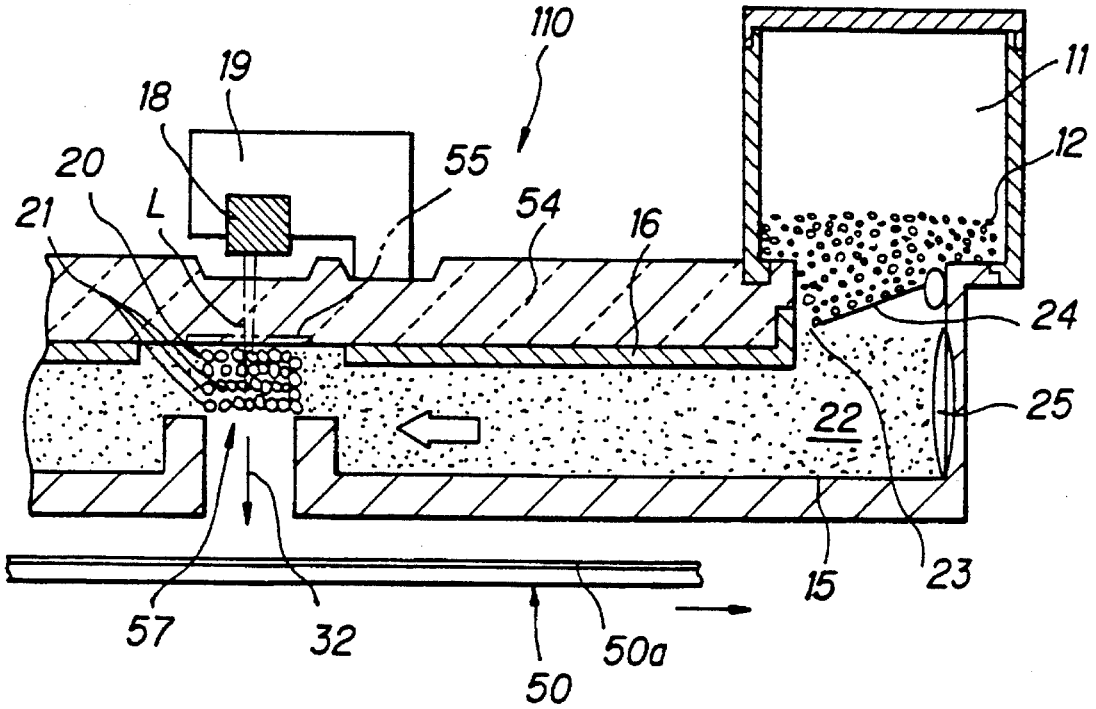
FIG. 20 is a cross section view of a recording unit according to another embodiment of the present invention.

The foregoing embodiments according to the present invention in common comprise effecting the recording on a recording paper located at the upper side of the head unit by irradiating a laser light from the lower side of the head unit. However, there is provided other embodiments in which the constitution is reversed. Referring to FIG. 20, a head unit of a reversed constitution is described below.

Referring to FIG. 20, a head unit 110 comprises a heater 16 under a light-transmitting lid plate 54. Solid dyes 12 which are supplied from each of the solid dye storage cells 11 are heated and fused by applying current to the heater 16 to provide liquefied dyes 22. Layers of beads 21 are laminated under the lid plate 54 to form a bead aggregate 20.

A semiconductor laser chip 18 is located on the upper side of the lid plate 54. The laser light L irradiated from the laser is converged by a lens (not shown in the figure) in the vicinity of the lower end of the bead aggregate to vaporize the liquefied dye. The thus liquefied dye is transferred via the vaporizing portion 57 to the dye receptor layer 50*a* of the recording paper 50 provided at the lower side of the vaporizing portion. Preferably, a photothermal conversion layer 55 illustrated with a virtual line (a series of two dots and a dash) in FIG. 20 is provided to the lid plate portion faced to the bead aggregate 20.

The rest of the structure are the same as those illustrated as the head unit 10 in FIG. 1.

In the recording mechanism described in the foregoing, the recording is effected by vaporizing the liquefied dye using laser irradiation. Preferably, however, a further efficient recording can be realized not only by utilizing the transfer of the dye from the surface of the liquid (i.e., evaporation), but also by vaporizing the liquefied dye from the inside of the dye layer (i.e., boiling).

A liquid can be boiled by elevating the temperature of the heating plane inside the liquid to a certain extent higher than the vaporization temperature of the liquid. More specifically, the liquid must be overheated. The difference between the temperature of the heating plane and the boiling point of the liquid (i.e., the degree of overheating) decreases with increasing number of bubble nuclei in the overheated plane, but increases with reducing number of bubble nuclei. That is, boiling initiates at a slightly high degree of overheating in the former case, but boiling occurs only after the degree of overheating becomes sufficiently high in the latter case. It can be seen therefore that recording can be effected at high efficiency by forming the bubble nuclei as many as possible.

The present inventors have found that the degree of overheating can be suppressed by substituting either partially or wholly the substance constituting the recording unit with a porous material comprising pores. The pores or the indents that are provided by the pores on the surface were found to function as the bubble nuclei for lowering the degree of overheating. The pores are preferably from 0.01 to 3 μm in average diameter. Porous materials comprising pores having a diameter of less than 0.01 μm in average cannot be fabricated easily, and the pores are too small for bubble nuclei. If large pores exceeding 3 μm in diameter were to be provided, the pores no longer function as bubble nuclei as to sufficiently lower the degree of overheating. Particularly preferred range of the average pore diameter is from 0.05 to 1 μm.

Preferably, the porous material is a heat resistant material which resists to a temperature of at least 300° C. It is also preferred that the liquefied dye does not intrude into the pores of the material. More specifically, a material having a low wettability is preferred. Specific examples of such porous materials include diatomaceous earth, silica, alumina, zeolite, and other porous ceramics, as well as active carbon.

The effect of porous substance was confirmed by conducting the following experiments on a recording unit having porous particles provided with pores which function as bubble nuclei set to the vaporizing portion.

EXPERIMENT 1

(1) Recording Chip

Figure 21A:
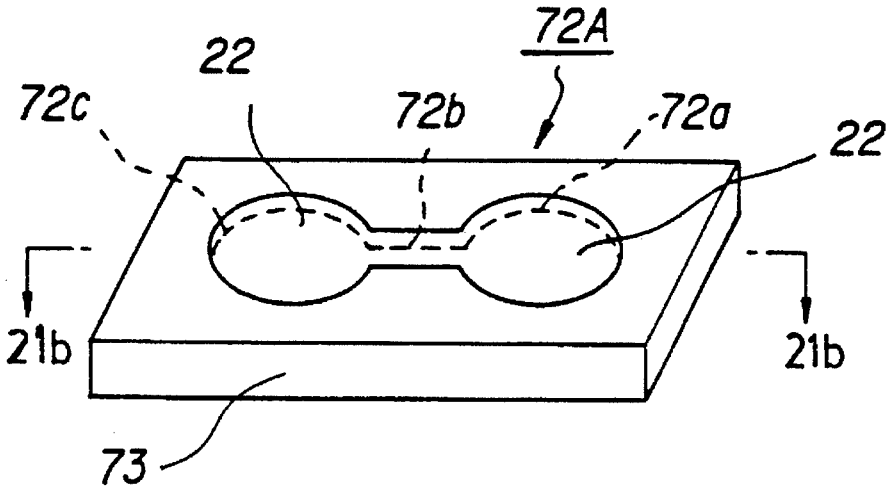
FIGS. 21 (*a*) and 21 (*b*) show a recording chip according to a still other embodiment of the present invention, wherein, FIG. 21 (*a*) is a perspective view of the chip, and FIG. 21 (*b*) is a cross section view taken along line b—b of FIG. 21 (*a*)
Figure 21B:
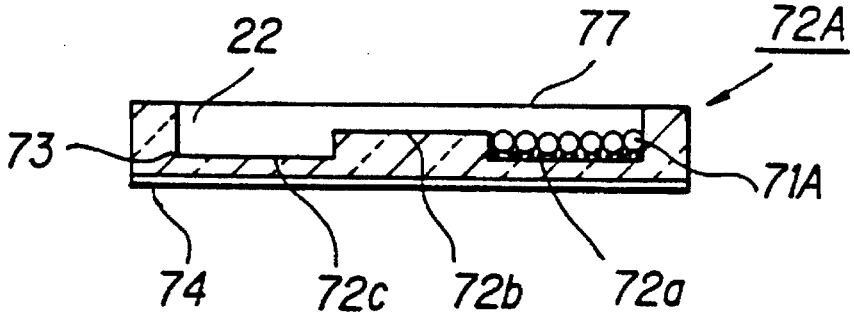

Referring to FIGS. 21 (*a*) and 21 (*b*), the recording chip used in the experiment is described below. FIG. 21 (*a*) is a perspective view of the recording chip, and FIG. 21 (*b*) is a cross section view of the chip along line b—b in FIG. 21 (*a*). The recording chip 72A was fabricated according to the following process. A chip substrate was prepared at first. The chip substrate comprises a glass substrate 73 provided thereon a first concave portion 72*a* for forming a vaporizing portion 77, a second concave portion 72*c* for forming a dye pool, and a groove 72*b* connecting the both concave portions. A coating of ITO (indium tin oxide) was provided as a clear electrically conductive film 74 to the back of the glass substrate 73.

Fine silica particles 71A having an average diameter of 5 μm and comprising a plurality of pores 0.1 μm in average pore diameter were dispersed in water, and the resulting water dispersion was applied to the first concave portion 72*a* of the chip substrate. The chip substrate was sintered thereafter in an autoclave at 600° C. for a duration of 10 minutes. Thus was obtained a complete recording chip 72A shown in FIG. 21.

Figure 22A:
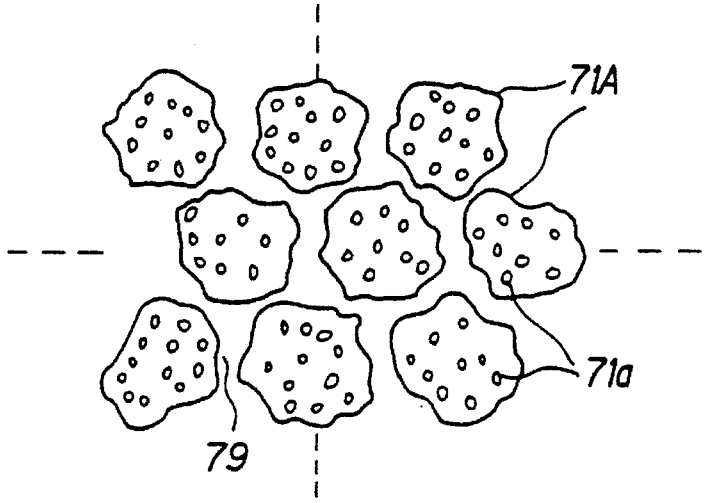
FIGS. 22 (*a*) to 22 (*c*) is diagram showing the enlarged view of fine-grained silica.
Figure 22B:
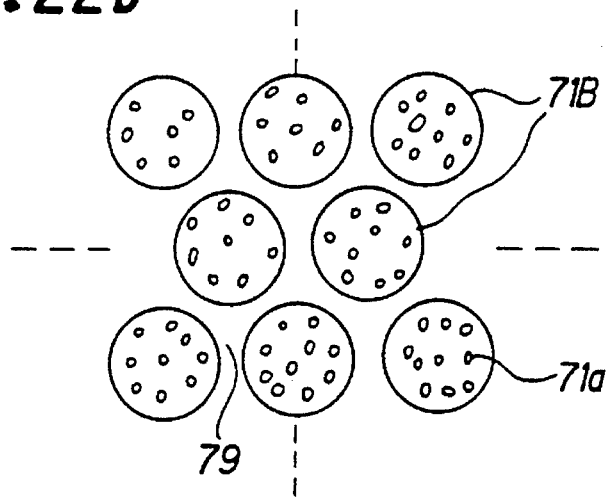
Figure 22C:
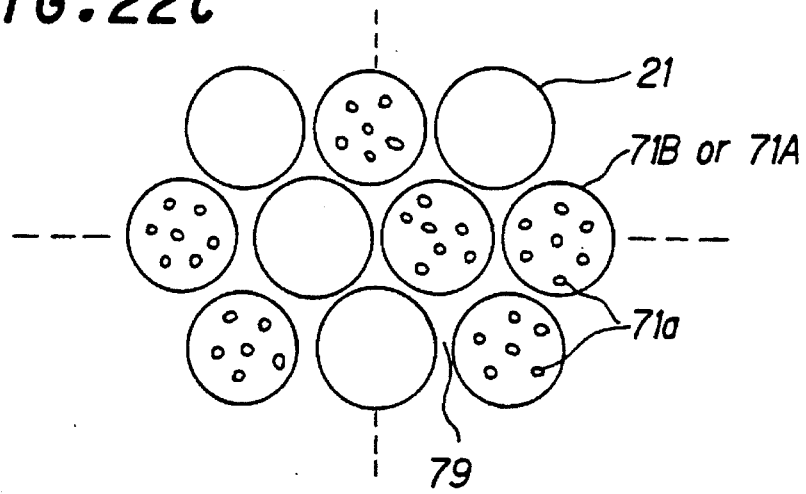

FIG. 22 (*a*) shows an enlarged schematic view of fine-grained silica incorporated into the recording chip. It can be seen that communicating pores 79 about 1 μm in average diameter are formed by the interstices among the fine-grained silica. Each of the silica grains 71A comprises pores 71*a* having an average pore diameter of 0.1 μm. The fine-grained silica 71A was obtained by crushing a sintering obtained from super-fine silica grains smaller than 5 μm in diameter into grains about 5 μm in average diameter. Originally, the pores 71*a* are interstices formed among the super-fine grains of the starting silica material.

(2) Dye

A dye was prepared by mixing 100 parts by weight of a tricyanostyryl magenta dye (produced by Mitsui Toatsu Chemicals, Inc.) having a melting point of 125° C. and a boiling point of about 420° C. with 2 parts by weight of a naphthalocyanine near-infrared absorbing dye having a maximum absorbing wavelength of about 780 nm. The mixed dye was completely dispersed using an ultrasonic stirrer at 150° C.

(3) Test Device

Figure 23:
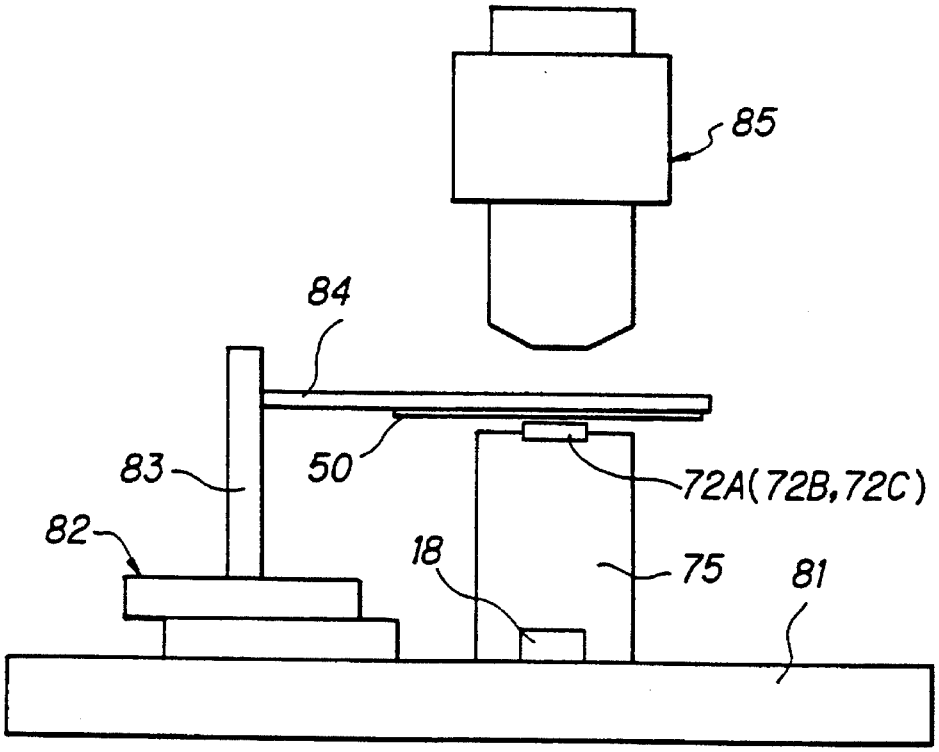
FIG. 23 is a schematic front view of a recording device used in an experiment.

Referring to the schematically shown front view of the essential portion in FIG. 23, a recording device was fabricated. An X-Y stage 82 is provided on a table 81, and a support 83 is established on the X-Y stage so that a frame bracket 84 to which detachable recording papers 50 are set thereto. A laser chip 18 comprising a semiconductor laser SLD203 is placed on the table 81 in such a manner that the laser light irradiated therefrom at a wavelength of 780 nm is converged at the vaporizing portion (indicated with numeral 77 in FIG. 21 (*b*)) of the recording chip 72 by an optical system (lens).

The optical density (recording density) of the recorded image on the recording paper 50 was measured using a microscopic spectrophotometer (Model U-6500, manufactured by Hitachi, Ltd.). The recording density thus measured was plotted on a separate recording paper (not shown in the figure) other than the recording paper 50. A monitoring microscope 85 for use in the observation of the recorded dots is also shown in the figure. The recording paper 50 after the recording was detached from the device and was subjected to the measurement of the recording density using the separately provided microscopic spectrophotometer above.

(4) Recording Test

The dye prepared in the foregoing was introduced into the first and the second concave portions 72*a* and 72*b* as well as into the groove 72*c* of the recording chip 72A as illustrated in FIG. 21. The glass substrate 73 was then heated to 150° C. by applying electric current to the clear conductive film 74. The dye was found to turn into a liquefied dye 22 having a smooth surface and a thickness of 4 μm. The recording chip 72A was assembled into the recording device shown in FIG. 23, and the recording paper 50 was fixed to the bracket 84. The recording paper 50 as used herein comprises a synthetic paper 180 μm in thickness having thereon a polyester mordant layer applied at a thickness of 6 μm. The recording chip was placed at a distance of 50 μm from the mordant layer.

Subsequently, the X-Y stage 82 was driven to effect the recording by moving the recording paper 50 at a relative speed of 2 cm/sec with respect to the recording chip 72. Considering that a dot size is 80×80 $\mu m^2$, a recording time of 4 msec per dot can be obtained.

Recording was completed by converging a laser light to the liquefied dye 22 transported upward through the communication pore 79 by capillary force to the vaporizing portion. Thus, the liquefied dye was vaporized and transferred to the recording paper 50. The vaporization of the liquefied dye was accelerated by the pores 71*a* which function as bubble nuclei to lower the degree of overheating. At this step, the recording chip was operated at a surface output of 30 mW to converge the laser light to a spot 5×10 $\mu m^2$ in size.

Figure 24:
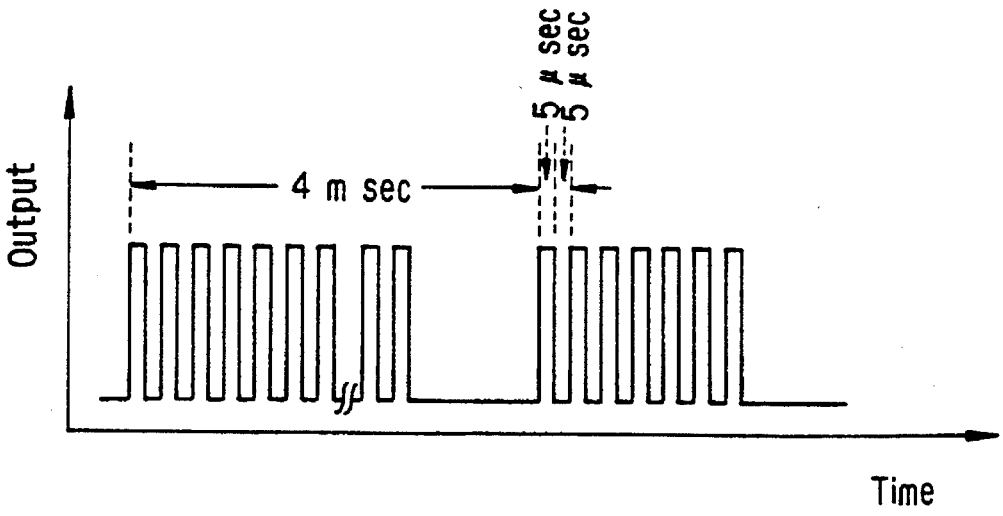
FIG. 24 is a graph showing the pulsed output of a laser used in recording.

The laser chip 18 was operated intermittently as illustrated in FIG. 24 to transfer the liquefied dye from the vaporizing portion according to the number of pulses. The dye transferred to the recording paper 50 diffuses into the dye layer when heated to 150° C. for a duration of 10 msec using a blade equipped with a heater (not shown in the figure). The dye can be fixed completely in the recording paper in this manner.

Figure 25:
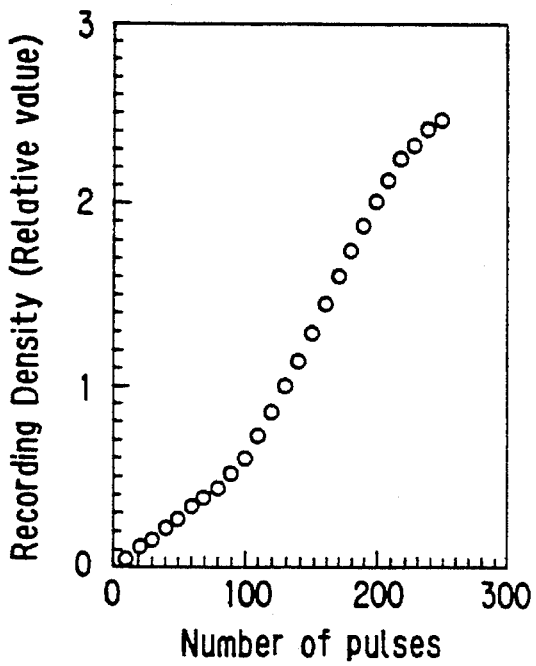
FIG. 25 is a graph showing the change in recording density obtained in an experiment with increasing pulses of laser output.

The relation between the number of pulses recorded in the separate paper above and the recording density is shown in the graph of FIG. 25. It was also confirmed that the recorded image is reproduced with 256 gradation. A maximum recording density was achieved with a spot 80 μm in diameter. The liquefied dye was continuously replenished from the second concave portion 72*c* according to the capillary force exerted by the groove 72*b* to the vaporizing portion 77 for the quantity consumed in the recording. Thus, no drop in recording density was observed during the recording.

Another experiment was conducted in the same manner as above, except for using morphologically modified spherical grains of fine silica 71B of FIG. 22 (*b*) instead of the fine-grained silica 71A shown in FIG. 22 (*a*). Similarly, yet other experiment was conducted in the same manner except for using a mixed powder of fine grained silica shown in FIG. 22 (*c*) and pore-free glass beads 21. Approximately the same result as that illustrated in FIG. 25 was obtained for each of the modified experiments.

EXPERIMENT 2

(1) Recording Chip

Particles of diatomaceous earth having an average diameter of 5 μm and comprising a plurality of pores 0.3 μm in average pore diameter were dispersed in a mixed solution below, and the resulting dispersion was applied to a glass substrate 73 at a thickness of 10 μm using a spin coater.

| Component | Quantity |
|---|---|
| Particles of Diatomaceous Earth | 100 parts |
| Polyimide (U-Varnish A, produced by Ube Industries, Ltd.) | 2 parts |
| 2-Methyl-1-pyrrolidone | 500 parts |

The resulting chip substrate was sintered thereafter in an autoclave at 250° C. for a duration of 10 minutes. Thus was obtained a complete recording chip similar to that shown in FIG. 21.

(2) Dye

The same dye as that used in the previous Experiment 1 was used.

(3) Test Device

The same recording device as that used in the previous Experiment 1 was used.

(4) Recording Test

Figure 26:
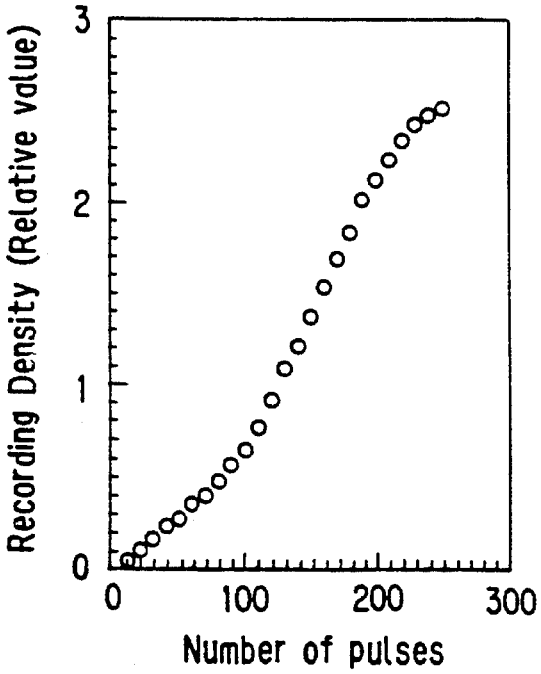
FIG. 26 is another graph showing the change in recording density with increasing pulses of laser output in another experiment performed on a dye differing from that used in the experiment corresponding to the graph of FIG. 25.

Recording was effected in the same manner as in the previous Experiment 1. The relation between the number of laser pulses and the recording density is shown in FIG. 26. It was also confirmed that the recorded image is reproduced with 256 gradation. A maximum recording density was achieved with a spot 80 μm in diameter. The rest of the observation are found the same as those obtained in the previous Experiment 1.

EXPERIMENT 3

(1) Recording Chip

Particles of diatomaceous earth having an average diameter of 5 μm and comprising a plurality of pores 0.3 μm in average pore diameter were dispersed in a mixed solution below, and the resulting dispersion was applied to a glass substrate 74 at a thickness of 10 μm using a spin coater.

| Component | Quantity |
|---|---|
| Particles of Diatomaceous Earth | 100 parts |
| Polyimide (U-Varnish A, produced by Ube Industries, Ltd.) | 2 parts |
| 2-Methyl-1-pyrrolidone | 500 parts |

Figure 27A:
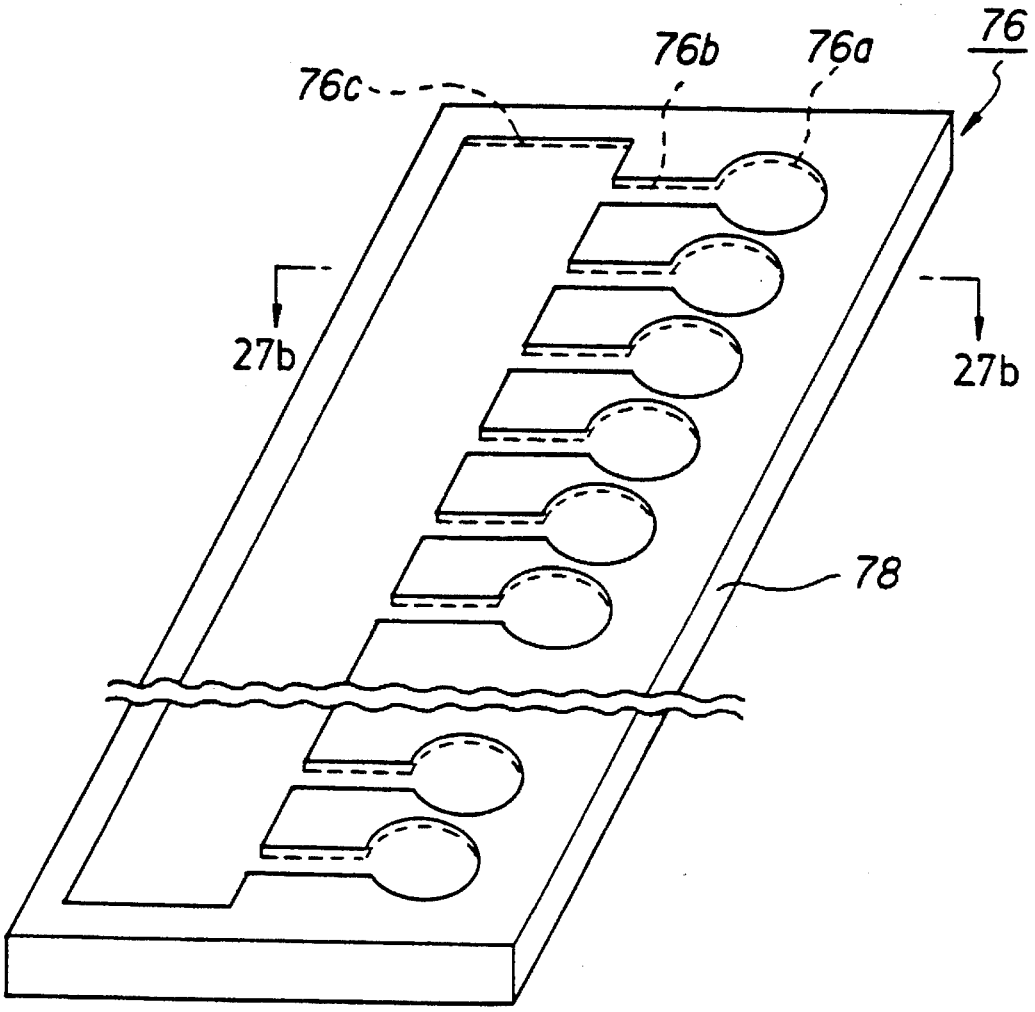
FIGS. 27 (*a*) and 27 (*b*) illustrate each a recording chip according to another embodiment of the present invention, wherein, FIG. 27 (*a*) is a perspective view of the chip, and FIG. 27 (*b*) is a cross section view along line b—b of FIG. 27 (*a*)
Figure 27B:
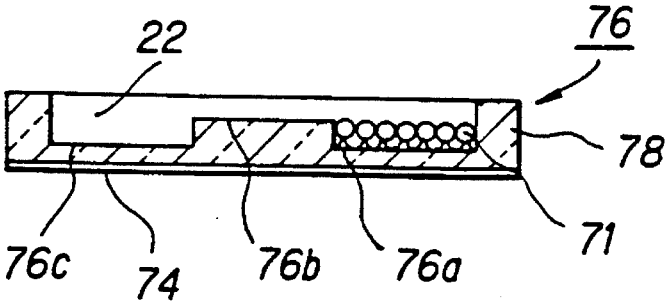

FIG. 27 (*a*) shows a perspective view of the recording chip, and FIG. 27 (*b*) is a cross section view of the recording chip along line b—b of FIG. 27 (*a*). The recording chip 76 comprises a rectangular glass substrate 78 having thereon a plurality of the recording chips 72A shown in FIG. 21 arranged continuously into an array. The glass substrate 78 comprises a plurality of first concave portions 76*a* , a common second concave portion 76*c*, and a plurality of grooves 76*b* connecting the first and the second concave portions.

(2) Dye

Three types of dyes, i.e., magenta, yellow, and cyan dyes were prepared. Magenta dye is the same as that used in the previous Experiments 1 and 2. Yellow dye and cyan dye were prepared from ESC-155 (produced by Mitsui Toatsu Chemicals, Inc.) and ESC-655 (produced by Mitsui Toatsu Chemicals, Inc.), respectively, by mixing each with Sudan Blue II, and 2% of naphthalocyanine dye was added in the same manner as in the case of magenta dye to each of the resulting mixed dyes. Dye dispersions were each prepared using an ultrasonic stirrer at 150° C.

(3) Test Device

Figure 28:
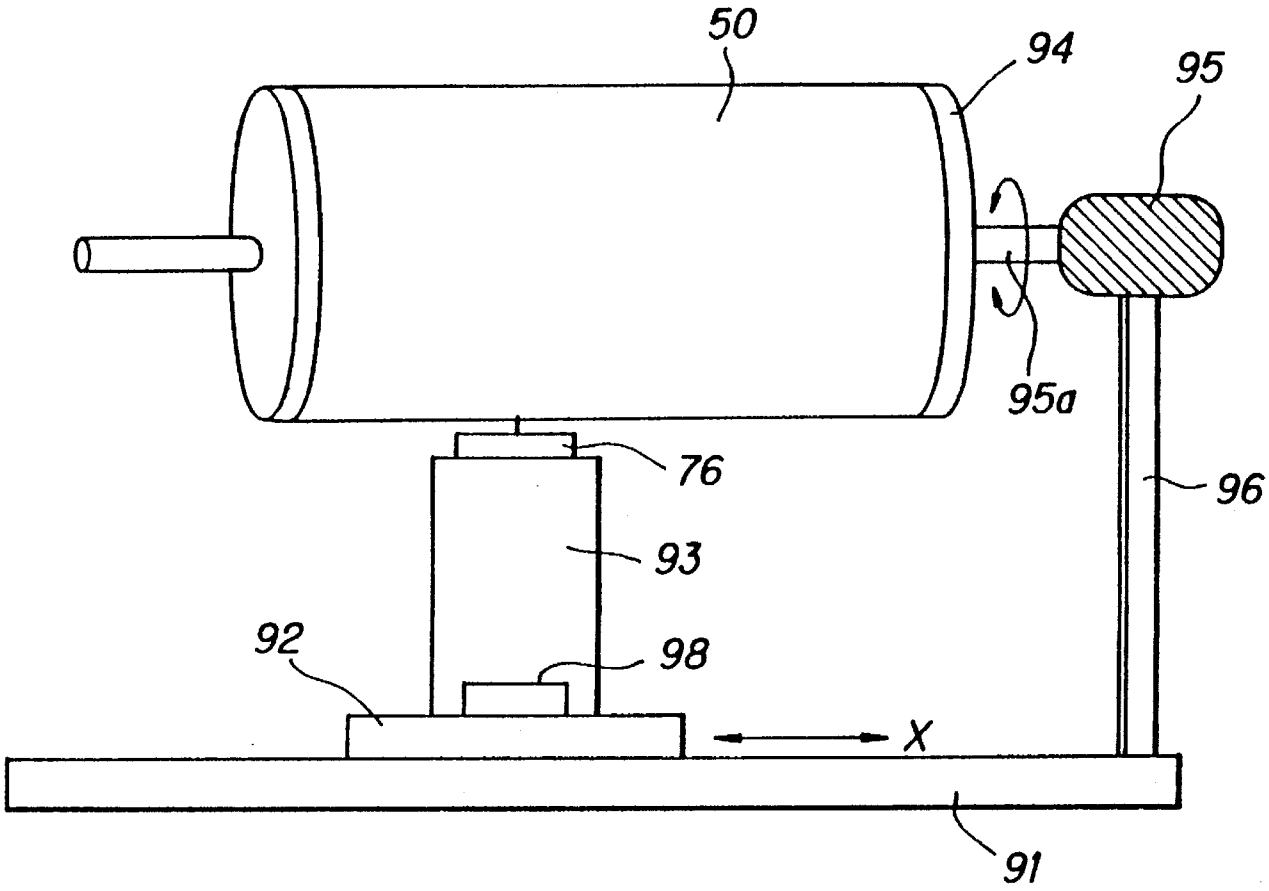
FIG. 28 is a schematic perspective view of a recording device used in the recording experiment.

FIG. 28 shows the schematic perspective view of the essential portion of the recording device. An X-stage 92 is provided on a table 91, and a laser chip 98 comprising a multi-semiconductor laser (a prototype) having twenty-four in-line light-emitting planes is placed on the X-stage 92 in such a manner that the laser light irradiated therefrom at a wavelength of 780 nm is converged at the vaporizing portion (inside the first concave portion 76*a*) of a recording chip 76 by an optical system (lens) 93.

A support 96 is established on the table 91 at a position along the X direction of the laser 98, and a DC motor 95 is fixed to the support 96. A platen roller 94 having thereon an A6-size recording paper 50 is attached to the shaft 95*a* of the DC motor 95. The same recording paper as that used in the previous Experiments 1 and 2 was used as the recording paper 50. The platen roller is placed in such a manner that the center axis line thereof be in parallel with the X direction, so that the recording paper 50 may be faced to each of the first concave portions 76*a* of the recording chip 76 located at the lowermost portion of the platen roller 94. The distance between the recording paper 50 and the first concave portions 76*a* is set in a range of from 40 to 50 μm.

(4) Recording Test

The recording chip 76 was assembled with the device illustrated in FIG. 28, and the yellow dye was introduced into the second concave portion 76*c*. The recording chip was heated to 150° C. by applying electric current to the clear electrically conductive film. The dye was molten to produce a liquefied dye layer having a smooth surface and a thickness of 4 μm in the first concave portions 76*a*.

The X-stage 92 was driven using a stepping motor while rotating the platen roller 94 at a relative peripheral velocity of 2 cm/sec with respect to the recording chip 76 to move the recording chip at a step of 2 mm per revolution of the platen roller. At the same time, recording was effected by allowing the laser 98 to emit a pulsed laser radiation corresponding to the yellow component of the color analyzed image information. Because twenty-four vaporizing portions 76*a* are arranged at a spacing of 83 μm in the recording chip 76, an A6-sized image with a resolution of 12 lines/mm (300 DPI (dots per inch)) was obtained by the recording operation above. The laser was operated at an output of 30 mW, and the light was converged to a spot 5×10 $\mu m^2$ in size at the vaporizing portion of the recording chip. The liquefied dye was found to be transferred to the recording paper in accordance with the number of laser pulses applied to effect the recording.

The dye transferred to the recording paper 50 in this manner diffused into the mordant layer and was fixed completely by heating the paper to 150° C. for 10 msec using a blade equipped with a heater (not shown in the figure). The liquefied dye was continuously replenished from the second concave portion 76*c* according to the capillary force exerted by the groove 76*b* for the quantity consumed in the recording. Thus, no drop in recording density was observed during the recording.

After the recording was completed for the yellow dye for the entire image, the recording chip 76 was replaced by those of magenta and cyan dyes to effect the recording sequentially in the same manner as in the case for the yellow dye. A high quality recording image well comparable to those obtained by silver halide photography was obtained for each of the dyes.

EXPERIMENT 4

(1) Recording Chip

Figure 29A:
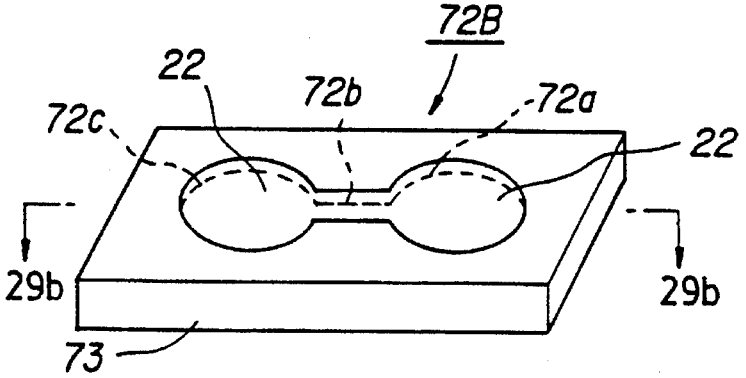
FIGS. 29 (*a*) and 29 (*b*) illustrate each a recording chip according to a still other embodiment of the present invention, wherein, FIG. 29 (*a*) is a perspective view of the chip, and FIG. 29 (*b*) is a cross section view along line b—b of FIG. 29 (*a*)
Figure 29B:
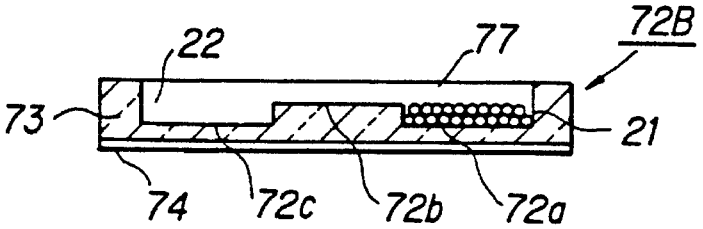

Referring to FIGS. 29 (*a*) and 29 (*b*), the recording chip used in the experiment is described below. FIG. 29 (*a*) is a perspective view of the recording chip, and FIG. 29 (*b*) is a cross section view of the chip along line b—b in FIG. 29 (*a*). The recording chip 72B is essentially the same as that used in Experiment 1 with reference to the recording chip 72A in FIG. 21, except for using glass beads 21 having a diameter of 10 μm in the place of the porous fine-grained silica 71.

(2) Dye

The same dye as that used in the previous Experiment 1 was used.

(3) Test Device

The same recording device as that used in the previous Experiments 1 and 2 was used.

(4) Recording Test

Figure 30:
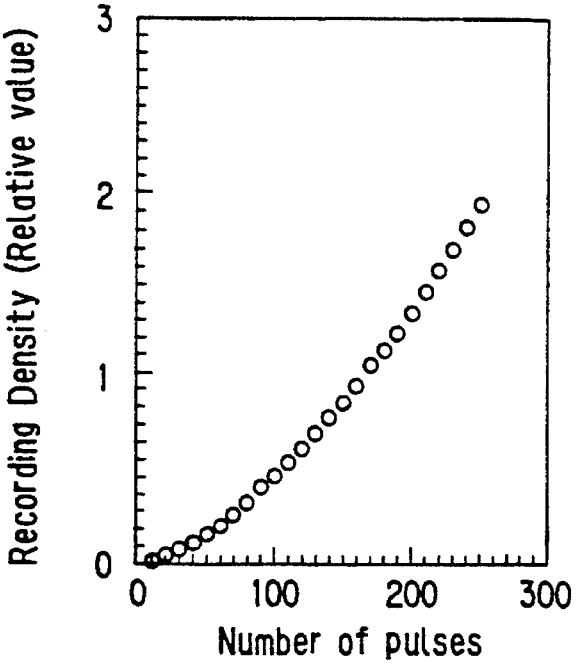
FIG. 30 is a graph showing the change in recording density with increasing pulses of laser output in a still other experiment.

Recording was effected in the same manner as in the previous Experiments 1 and 2. The relation between the number of laser pulses and the recording density is shown in the graph of FIG. 30. The rest of the observations were exactly the same as those obtained in the previous Experiment 1. The present experiment concerns with the structure corresponding to the recording unit with reference to FIG. 4.

COMPARATIVE EXPERIMENT

For comparison, an experiment was conducted in the same manner as in the previous experiments 1, 2, and 4, except for using none of the porous fine-grained silica and diatomaceous earth, nor the glass beads.

(1) Recording Chip

Figure 31A:
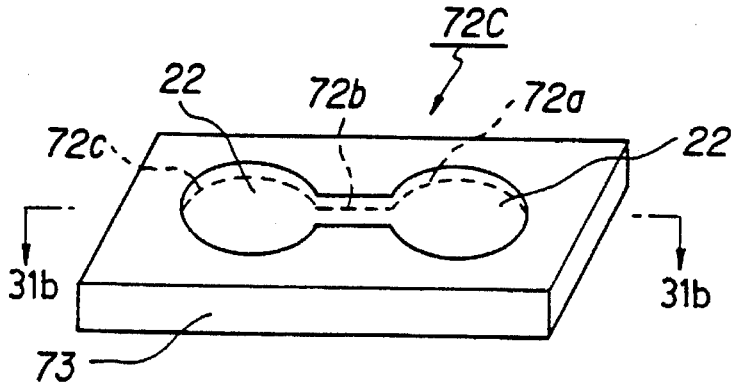
FIGS. 31 (*a*) and 31 (*b*) illustrate each a recording chip according to a still yet other embodiment of the present invention, wherein, FIG. 31 (*a*) is a perspective view of the chip, and FIG. 31 (*b*) is a cross section view along line b—b of FIG. 31 (*a*)
Figure 31B:
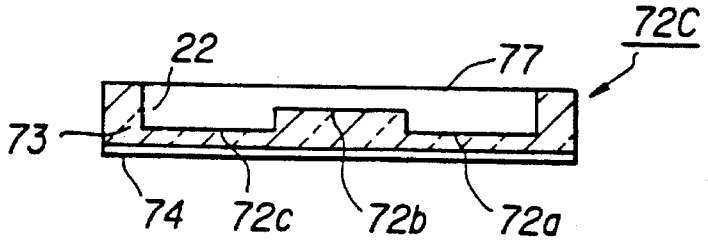

FIGS. 31 (*a*) and 31 (*b*) show the recording chip used in the experiment. FIG. 31 (*a*) is a perspective view of the recording chip, and FIG. 31 (*b*) is a cross section view of the chip along line b—b in FIG. 31 (*a*).

(2) Dye

The same dye as that used in the previous Experiment 1 was used.

(3) Test Device

A device shown in FIG. 23 was used.

(4) Recording Test

Figure 32:
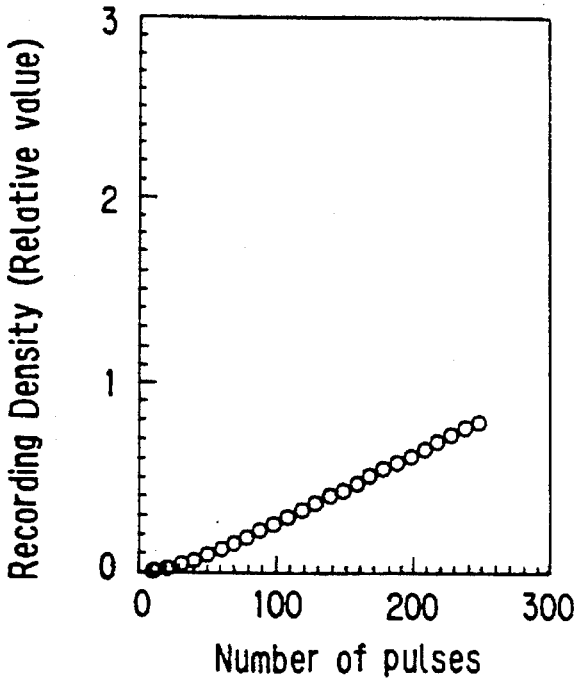
FIG. 32 is a graph showing the change in recording density with increasing pulses of laser output using the recording chip illustrated in FIG. 31.
Figure 33:
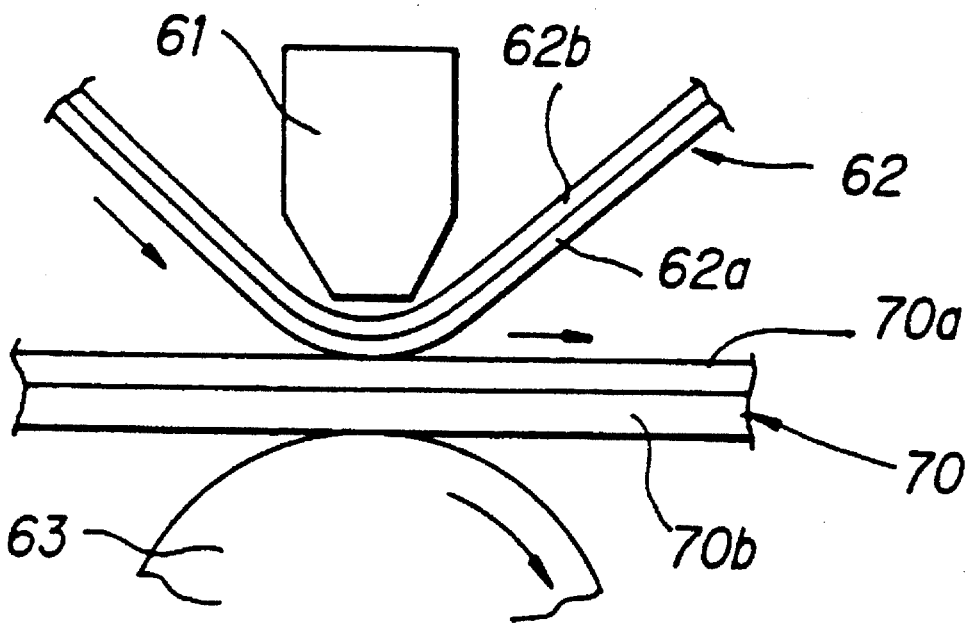
FIG. 33 is a front view of the essential portion of a recording device using a thermosensitive recording head of a related art.
Figure 34:
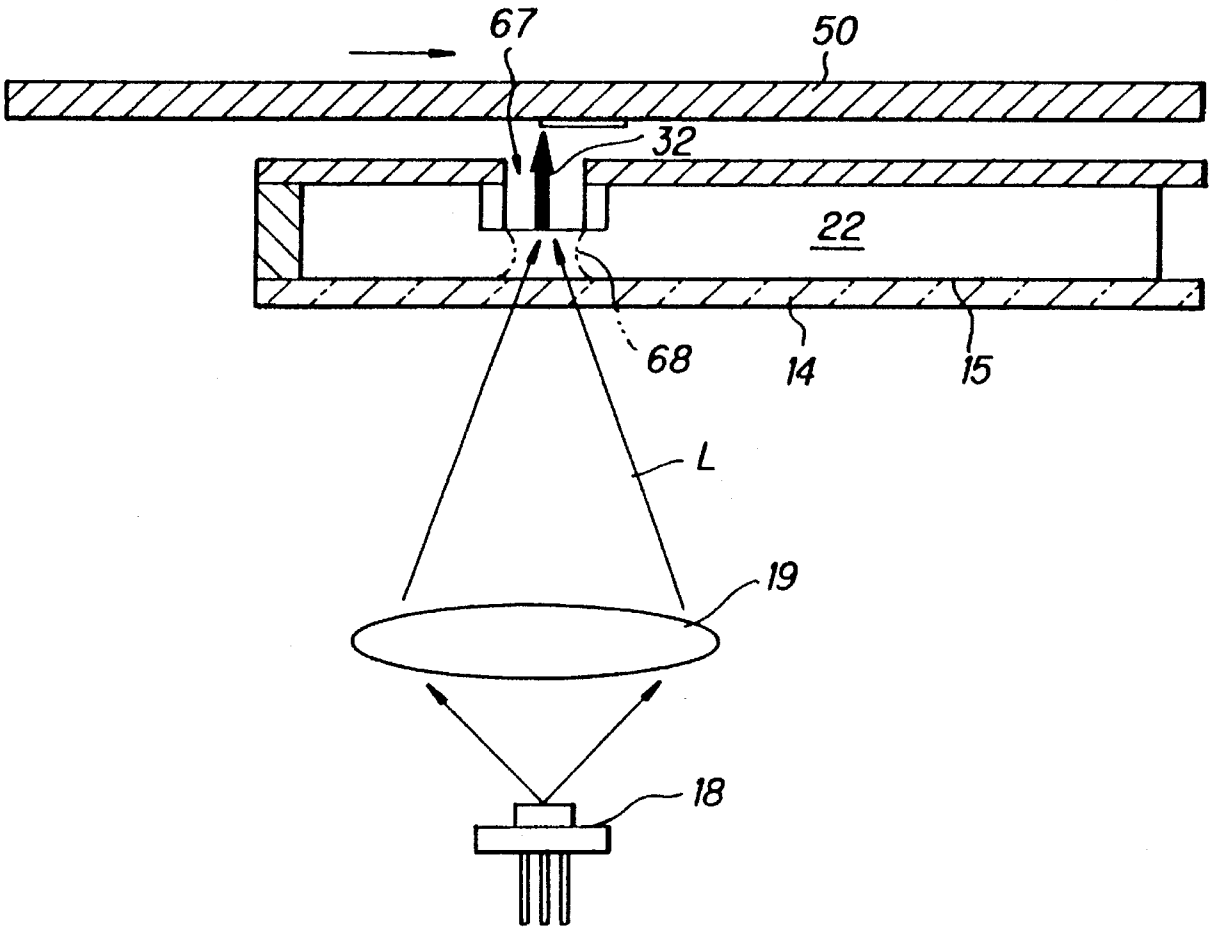
FIG. 34 is a partial cross section of a recording unit about to be completed.

A relation between the number of laser pulses and the recording density as illustrated in FIG. 32 was obtained as a result.

It can be seen from the results obtained in Experiment 4 in comparison with the Comparative Experiment that the recording density can be considerably improved by forming communicating pores using glass beads inside the vaporising portion. This can be clearly understood by comparing the graph in FIG. 30 with that in FIG. 32. Furthermore, by comparing the results obtained in Experiments 1 and 2 (FIGS. 25 and 36) with those of the Experiment 4 (FIG. 30) and the Comparative Experiment (FIG. 32), it can be seen that the use of fine porous grains ameliorates the dye retention and further improves the quality of the recording density and continuous gradation in correspondence with the number of laser pulses. It is also confirmed from the results obtained in Experiment 3 that a full-colored image having excellent image quality can be obtained by the recording unit and device according to the present invention.

The communicating pores 29 and 39 shown in FIGS. 4 and 9, respectively, function as bubble nuclei as well as a mechanism for supplying liquefied dye according to the capillary phenomena. Thus, the communicating pores accelerate the vaporization of the dye. The columns 31 illustrated in FIGS. 9 and 12 can be made porous to impart thereto a function as a bubble nuclei in addition to that as a mechanism for supplying the liquefied dye.

Although porous fine grains are used for forming communicating pores in the above Experiments 1, 2, and 3, porous blocks having a plurality of pores can be placed in the vaporizing portion as a substituent for the porous fine grains, because the pores in the block function as the bubble nuclei as well. Thus, the porous blocks also lowers the degree of overheating to accelerate the vaporization of the dye.

The present invention has been described in detail referring to specific embodiments above. However, various modifications and changes can be made without departing from the spirit and scope of the invention.

Examples of the modified embodiment include, instead of vaporizing the solid dye after once fusing it into a liquefied dye, directly vaporizing, i.e., gasifying or sublimating, the solid dye by irradiating a laser beam thereto. Otherwise, a liquefied dye which is originally a liquid at room temperature can be pooled in the dye storage cells 11.

Furthermore, the structure and the shape of the recording layer as well as the head unit can be properly modified, and there is no particular restriction concerning the material constituting the head unit so long as the material is suitable for the head unit.

Mono-colored recording or black-and-white recording can be effected instead of full-color recording using the three primaries, magenta, yellow, and cyan for the recording dyes.

The recording dyes can be transferred to the recording paper not only by vaporizing the liquefied dye, but also by utilizing sublimation or ablation of the solid dye. Ablation refers to an etching phenomena which occurs on a substance when laser beam is irradiated, attributed to the partial ejection of the substance by the boiling power and not by gasification.

It is also possible to use other types of energy in addition to laser light to effect the vaporization or sublimation of the recording material such as the dyes. Examples of the other types of energy include other electromagnetic radiation and a discharge using a stylus electrode.

As described in foregoing, the recording unit structure and the recording device according to the present invention comprises pores in the vaporizing portion of the recording material. Accordingly, the vaporization of the recording material can be accelerated to realize a recording with high efficiency and with high quality.

Because the recording material is not brought into direct contact with the material to which the recording is made in the present invention, the recording material need not be supplied by mounting it on a carrier. Thus, the unused recording material remaining on the carrier as well as the carrier need not be disposed as wastes. Furthermore, a high energy efficiency is achieved in the present invention because the recording material alone is heated. The application of load for bringing the recording material into contact with the material in which the recording is made is also eliminated in the present invention. This leads to the fabrication of a light-weight compact recording device.

In case of recording a plurality of superposed recording materials, there is no fear of reversely transferring the previously recorded material to the newly superposed recording material. Accordingly, no staining of recording materials occurs in the present invention.

While the invention has been described in detail and with reference to specific embodiments thereof, it will be apparent to one skilled in the art that various changes and modifications can be made therein without departing from the spirit and scope thereof.

What is claimed is:

1. A recording unit for use in a laser-vaporizing color video printer comprising:

a container body including a bottom plate and a lid plate defining a liquified dye reservoir, said lid plate including an inwardly recessed vaporizing opening;

a porous member disposed in said container body in alignment with said vaporizing opening extending from said bottom plate to an opposed vaporizing surface disposed at said vaporizing opening, said porous member including communicating pores extending inside the porous member to said vaporizing surface;

a heater disposed in the dye reservoir to maintain the dye in a liquified state; and a substantially binder free, liquified vaporizable dye disposed in said liquified dye reservoir.

2. A recording unit structure as claimed in claim 1, wherein, the porous member comprises an aggregate of a plurality of fine particles.

3. A recording unit as defined in claim 2, wherein the plurality of fine particles in said aggregate are of substantially uniform size.

4. A recording unit as defined in claim 2, wherein the plurality of fine particles in said aggregate are not the same size.

5. A recording unit structure as claimed in claim 1, wherein, the porous member and its communicating pores are formed by photolithography.

6. A recording unit structure as claimed in claim 1, wherein, the porous member comprises a plurality of fibrous bodies.

7. A recording unit structure as claimed in claim 1, wherein, the porous member comprises a porous material selected from the group consisting of pumice, a metallic sintering and a ceramic sintering.

8. A recording unit structure as claimed in claim 1, wherein, the porous member has a coating on at least the vaporizing surface.

9. A recording unit structure as claimed in claim 8, wherein, the coating layer comprises a metal which absorbs infrared radiation.

10. A recording unit structure as claimed in claim 8, wherein, the coating layer comprises a heat insulating material or a reflection preventive material.

11. A recording unit structure as claimed in claim 1, wherein, a layer of a heat insulating material is provided on an inner surface of the bottom plate.

12. A recording unit structure as claimed in claim 1, wherein, in the porous member the communicating pores are varied in size and are distributed with a uniform spacing, the communicating pores are of a uniform size and are distributed without being equally spaced, or the communicating pores are varied in size and are distributed without being equally spaced.

13. A recording unit structure as claimed in claim 1, wherein, in the porous member, the communicating pores are from 0.01 to 3 μm in average pore diameter.

14. A recording unit structure as claimed in claim 13, wherein, the pores from 0.01 to 3 μm in average pore diameter are formed in such a manner that they may be present in at least a part of a pore-forming body.

15. A recording unit structure as claimed in claim 1, wherein, said vaporizable dye further comprises a light absorbing agent.

16. A recording unit as defined in claim 1, further comprising a vibrator disposed in said liquified dye reservoir.

* * * * *